US008424341B2

(12) United States Patent
Summerford

(10) Patent No.: US 8,424,341 B2
(45) Date of Patent: Apr. 23, 2013

(54) NECKLACE COVER

(76) Inventor: Candace M. Summerford, Boston, MA (US)

( * ) Notice: Subject to any disclaimer, the term of this patent is extended or adjusted under 35 U.S.C. 154(b) by 192 days.

(21) Appl. No.: 12/405,374

(22) Filed: Mar. 17, 2009

(65) Prior Publication Data

US 2010/0236287 A1 Sep. 23, 2010

(51) Int. Cl.
*A44C 25/00* (2006.01)

(52) U.S. Cl.
USPC ..... 63/33; 63/21; 206/6.1

(58) Field of Classification Search ..... 63/3, 3.1, 63/33, 40; 150/153, 161, 154; 206/6.1; 119/856, 119/858, 863; D30/152; 132/273, 275; 2/170, 2/46, 171; 24/116 R, 116 A, 122.3
See application file for complete search history.

(56) References Cited

U.S. PATENT DOCUMENTS

| | | | | | |
|---|---|---|---|---|---|
| 1,906,747 | A | * | 5/1933 | Garnetz | 223/105 |
| 2,016,210 | A | * | 10/1935 | Mann | 2/171 |
| 2,885,684 | A | * | 5/1959 | Dye et al. | 2/300 |
| 3,251,066 | A | * | 5/1966 | Takacs | 2/46 |
| 4,266,511 | A | * | 5/1981 | Muench | 119/858 |
| 4,281,211 | A | * | 7/1981 | Tatum et al. | 174/36 |
| 4,377,078 | A | * | 3/1983 | Block | 63/3.1 |
| 4,611,368 | A | * | 9/1986 | Battersby | 24/116 R |
| 4,697,436 | A | * | 10/1987 | Schmidt | 63/3 |
| 4,719,876 | A | * | 1/1988 | Wilken | 119/815 |
| 4,939,778 | A | * | 7/1990 | Tomberlin | 379/438 |
| 4,954,939 | A | * | 9/1990 | Hutchins | 362/406 |
| 5,109,803 | A | * | 5/1992 | Dunham et al. | 119/654 |
| 5,432,986 | A | | 7/1995 | Sexton | |
| 5,524,885 | A | * | 6/1996 | Heo | 473/299 |
| 5,669,242 | A | | 9/1997 | Cayton | |
| 5,687,585 | A | * | 11/1997 | Ferrell | 63/21 |
| 5,878,698 | A | * | 3/1999 | Lyell | 119/863 |
| 6,023,786 | A | * | 2/2000 | Burnett | 2/170 |
| D445,093 | S | * | 7/2001 | Staskey | D13/156 |
| 6,293,127 | B1 | | 9/2001 | Nakagawa | |
| 6,422,177 | B1 | * | 7/2002 | Noguero | 119/856 |
| 6,554,033 | B2 | * | 4/2003 | Hydon | 150/155 |
| 6,612,130 | B2 | | 9/2003 | Ito | |
| 6,662,597 | B2 | * | 12/2003 | Vanasse | 63/3.1 |
| D521,207 | S | * | 5/2006 | Anderson et al. | D34/27 |
| 7,168,394 | B2 | * | 1/2007 | Berry | 119/863 |
| D558,932 | S | * | 1/2008 | Farrar | D30/152 |
| 7,438,964 | B2 | * | 10/2008 | Clark | 428/40.1 |
| 7,454,818 | B1 | * | 11/2008 | Backman, III | 24/300 |
| 2004/0182412 | A1 | * | 9/2004 | Vogel | 132/279 |

* cited by examiner

*Primary Examiner* — Jack W Lavinder
*Assistant Examiner* — Abigail E Morrell
(74) *Attorney, Agent, or Firm* — Candace M. Summerford

(57) ABSTRACT

The invention relates to a necklace cover, or sleeve, which covers jewelry that is worn around the neck. The necklace cover is designed to be worn at the back of a neck and is worn over a piece of jewelry to prevent tangling of hair, hair breakage, and/or damage to a persons clothing (e.g. snags or pulls) that often occurs when a person wears jewelry around the neck. Methods for preventing a wearer's hair from getting tangled in a jewelry composition worn around the neck of a wearer are also provided.

7 Claims, 13 Drawing Sheets

NECKLACE COVER

FIELD OF INVENTION

The present invention relates generally to a necklace accessory that provides a means for preventing hair from getting tangled in jewelry, as well as provides a means for preventing damage to a person's clothing, e.g. snags or pulls in scarves or shirt collars, that often occurs when wearing jewelry around the neck.

BACKGROUND

Many necklaces, when worn, have the tendency to cause hair breakage, or tangling of the wearer's hair. Hair can get caught, or tangled, either in or around the jewelry composition, e.g. metal chain or beads, or can get caught in or around the necklace clasp. Necklaces can also cause "pulls" in clothing, such as scarves, or shirt collars.

Necklaces with specific uses have been described, for example a rotation preventing necklace, (See U.S. Pat. No. 6,293,127), and a necklace that has an adjustable loop capable of changing the size of the necklace, (See U.S. Pat. No. 6,612,130). Necklace extensions and "easy close" clasps have also been described, see U.S. Pat. Nos. 5,669,242 and 5,432,986. However, none of the necklaces are designed to prevent hair breakage and pulls or snags in clothing.

Thus, there remains a need for means to prevent clothing snags caused by jewelry and a means to prevent hair from tangling in jewelry that is worn around the neck.

SUMMARY OF INVENTION

The present invention is directed to necklace covers, or sleeves, which cover jewelry that is worn around the neck. The present invention solves the problem of hair getting tangled in jewelry worn around the neck. Tangling of hair in necklaces is often painful and causes hair breakage. This problem ultimately leads the user not to wear the necklace and not to purchase any similar styled necklaces for future use. The present invention also solves the problem of snags or pulls that often occur in clothing when a person wears jewelry around the neck. The necklace covers protect clothing from damage, enabling users to wear their jewelry more often, e.g. with silk scarves.

One aspect of the present invention is a necklace cover that comprises at least one tubular material member having a first end and a second end, a lumen for passage of a jewelry composition, and at least one fastener means disposed on the tubular material member for securing said necklace cover along the jewelry composition, wherein the tubular material member is adapted to cover a jewelry composition that is worn around a wearer's neck at a point where said jewelry composition lies at the back of a neck of a wearer. The necklace cover comprising at least one tubular material member is worn by a person by threading the jewelry composition through the tubular member prior to wearing the jewelry around the neck. After wearing the jewelry, the tubular member is then positioned by the person to lie at the back of a neck (e.g. positioned over any clasp), thereby preventing tangling of the person's hair in the jewelry composition and/or protecting the person's clothing from damage. A means for pulling the tubular material member across said jewelry composition can also be disposed on the tubular member, such that the necklace cover can be positioned at the back of the neck of the wearer. In one aspect, the necklace cover that comprises at least one tubular material member includes an ornamental item or a decorative edge on the tubular member. The necklace cover that comprises at least one tubular material member can be disposable.

Another aspect of the present invention is a necklace cover, comprising a) at least one tubular material member having a first end and a second end; b) the tubular material member including a lumen for passage of a jewelry composition; and c) disposed on the tubular material member a means for pulling the tubular material member across the jewelry composition such that the necklace cover can be positioned at the back of the neck of the wearer. The tubular member comprises a stretchy material that conforms to the shape of the jewelry composition. The tubular material member is further adapted to cover a jewelry composition that is worn around a person's neck at a point where said jewelry composition lies at the back of a neck of a wearer. In one aspect, the necklace cover includes an ornamental item or a decorative edge. In one aspect, the necklace cover is disposable.

Another aspect of the present invention is a necklace cover comprising: a) a symmetrical shaped material member having at least one axis of symmetry and at least two symmetrical portions; and b) at least one attachment means for releasably connecting the two symmetrical portions to each other, wherein the symmetrical shaped material member is adapted to encase a jewelry composition that lies at the back of a neck of a wearer. The necklace cover can be worn by the wearer by connecting the at least two symmetrical portions to each other, such that the symmetrical shaped member encases the jewelry composition at a point where the jewelry composition lies at the back of the neck of the wearer. In one aspect, the necklace cover further comprises a fastener means for securing the necklace cover along the jewelry composition, thereby preventing the cover from sliding along the jewelry composition when no force is applied. In one aspect, at least one of the two symmetrical portions has a slip resistant material to prevent sliding of the necklace cover along the jewelry composition. In one aspect, the necklace cover includes an ornamental item or decorative edge. In one aspect, the necklace cover is disposable.

Another aspect of the present invention, is a package comprising a necklace cover according to the invention. In one aspect, the package that comprises a necklace cover (e.g. comprising either tubular member or symmetrical shaped member necklace cover of the invention) further comprises a necklace, or jewelry cleaner, or a jewelry box, or jewelry organizer, or non-necklace jewelry items (e.g. earrings, bracelets, anklet bracelets, rings, pins etc.), or a hair care product. Hair products include, for example, hair accessories such as barrettes and other hair holding products (e.g. bobypins, hair bands, hair ties), hair comb, hair brush; hair styling products, such as shampoo, conditioner, styling mousse, gel, and hairspray; and hair appliances (e.g. curling iron, curlers, hair dryer, hair dryer accessories etc.).

Another aspect of the present invention is a method for preventing a wearer's hair from getting tangled in a jewelry composition worn around the neck of a wearer. The method comprises providing a necklace cover to a wearer, wherein said necklace cover is adapted to cover or encase a jewelry composition worn around the neck of a wearer.

Another aspect of the present invention is a method for preventing a wearer's hair from getting tangled in a jewelry composition worn around the neck of a wearer that comprises: providing to the wearer a necklace cover comprising at least one tubular member having a first end and a second end and a lumen. In one aspect, the method further comprises providing a necklace cover threader. The necklace cover is worn by the wearer by threading a jewelry composition through the tubular member, placing the jewelry composition around the neck of the wearer; and positioning said necklace cover to lie at the back of the neck, thus substantially preventing tangling of the wearer's hair in said jewelry composition or protecting the wearers clothing from damage. In one aspect the necklace cover is made of a slip resistant material on an interior of the necklace cover such that the necklace cover does not freely slide along the jewelry composition without applied force. In one aspect, the method further comprises providing a fastener means for securing said necklace cover along the jewelry composition. In one aspect, the necklace cover provided further comprises a fastener. In one aspect, the necklace cover provided comprises a stretchy material.

Another aspect of the present invention is a method of preventing a wearer's hair from getting tangled in a jewelry composition worn around the neck of a wearer, comprising providing to the wearer a necklace cover comprising a symmetrical shaped material member having at least one axis of symmetry and at least two symmetrical portions, and at least one attachment means for releasbly connecting the at least two symmetrical portions to each other, wherein said necklace cover is worn by the wearer by connecting the symmetrical portions to each other such that the symmetrical shaped material member encases a jewelry composition at a point where the jewelry composition lies at the back of the neck of the wearer, thereby substantially preventing tangling of the wearers hair in the jewelry composition or protecting the wearer's clothing from damage. The necklace cover can be made of stretchy material, e.g. stretchy fabric. The necklace cover can disposable.

It should be understood that the necklace cover provided in the methods of the invention can be any variation of necklace covers described herein throughout the application.

Another aspect of the present invention is a necklace cover comprising at least one tubular member having a first end and a second end, the tubular member having a lumen for passage of a jewelry composition, and a slip resistant material positioned along the lumen on an interior of the tubular member, wherein the tubular material member is adapted to cover a jewelry composition that is worn around a wearer's neck at a point where the jewelry composition lies at the back of a neck of a wearer.

Another aspect of the present invention is a necklace cover comprising at least one tubular member having a first end and a second end, the tubular member having a lumen for passage of a jewelry composition; and a fastener disposed on said tubular member, wherein the tubular material member is adapted to cover a jewelry composition that is worn around a wearer's neck at a point where the jewelry composition lies at the back of a neck of a wearer. In one aspect the fastener is selected from the group consisting of hooks, snaps, buttons, hook and loop material, adhesive material, slip-resistant material, re-attachable adhesive, ties, elastic, magnets, clips, and clasps.

Another aspect of the present invention is a necklace cover comprising: a) a symmetrical shaped material member having at least one axis of symmetry and at least two symmetrical portions; and b) at least one fastener disposed on said symmetrical shaped material member that is positioned to connect the two symmetrical portions to each other, wherein the symmetrical shaped material member is adapted to encase a jewelry composition that lies at the back of a neck of a wearer. In one aspect the fastener is selected from the group consisting of hooks, snaps, buttons, hook and loop material, adhesive material, slip-resistant material, re-attachable adhesive, ties, elastic, magnets, clips, and clasps.

BRIEF DESCRIPTION OF FIGURES

FIG. 12A showing a necklace covered by the necklace cover and an embodiment of ornamental items and a decorative edge. FIG. 12B shows the interior view of the necklace cover, where a slip resistant material covers at least part of the interior of the cover, in this case, the entire interior of at least one interior side of the cover (side A or side B).

DETAILED DESCRIPTION OF THE INVENTION

Figure 1:
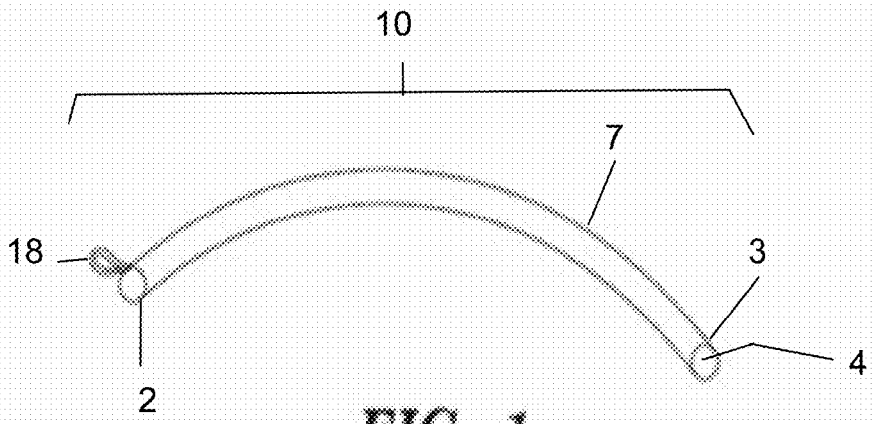
FIG. 1 is a perspective view of a first embodiment of the necklace cover of the present invention.

The present invention relates to necklace covers or sleeves, which cover jewelry that is worn around the neck. The necklace covers are designed to be worn at the back of a neck and are worn over a piece of jewelry to prevent tangling of hair, hair breakage, and/or damage to a person's clothing, e.g. snags or pulls, that often occur when a person wears jewelry around the neck.

Referring to FIGS. 1-4, a necklace cover, referred to generally by reference numeral 10, includes at least one tubular material member 7 having a first end 2 and a second end 3, and a lumen 4 for passage of a jewelry composition 14. A means 18 for pulling the tubular material member 7 across the jewelry composition 14, such that the necklace cover can be positioned at the back of the neck of the wearer, e.g. tab or string is deposited on the tubular member such that a wearer can grab onto the tab (See FIG. 2) to forcibly slide or pull tubular member 7 along a jewelry composition 14, including any clasp of the necklace. Tubular material member 7 is adapted to cover jewelry composition 14 when it is worn around a person's neck at a point where jewelry composition 14 lies at the back of a neck 15 of a wearer (See for example FIG. 14).

Referring to FIGS. 8-13 and FIGS. 19-20, a necklace cover 10, is provided that comprises at least tubular material member 7 having a first end 2 and a second end 3, a lumen 4 for passage of a jewelry composition 14, and at least one fastener means 5 for securing said necklace cover along the jewelry composition 14, wherein the tubular material 7 member is adapted to cover a jewelry composition 14 that is worn around a person's neck at a point where said jewelry composition 14 lies at the back of a neck 15 of a wearer. When necklace cover 10 lies flat, it should be appreciated that there may be no observable space in the center of the cover, however, the cover can be manipulated, i.e. squeezed, such that a space (lumen) can be observed for passage of jewelry composition 14.

As used herein, a "tubular shaped material member 7" or "tubular member 7" refers to any material (e.g. fabric, paper, or plastic) having a first end and a second end formed such that it has a lumen, the first end and second ends being open ends. As used herein, a "lumen" refers not only a cylindrical hollow center but also to space that allows for passage of a jewelry composition through the necklace cover.

Figure 3:
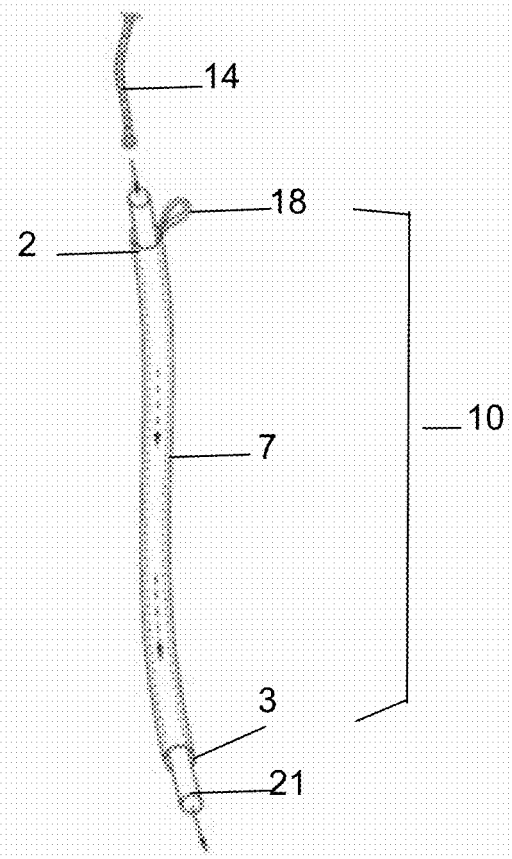
FIG. 3 is a perspective illustrating another method of threading the necklace through the necklace cover according to the present of the invention.
Figure 4:
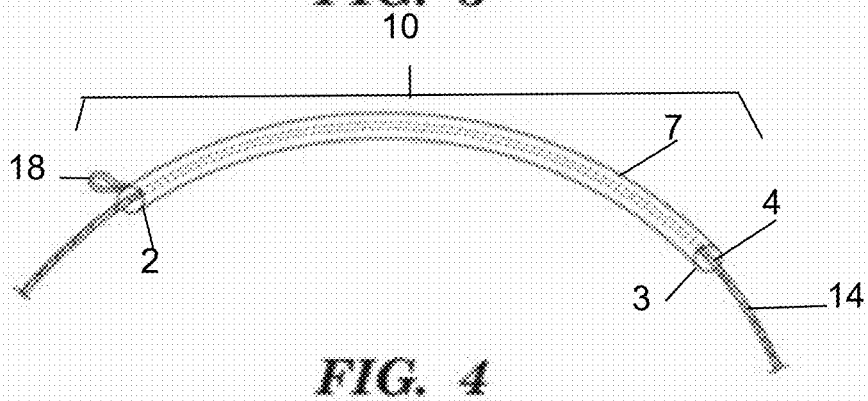
FIG. 4 is a perspective view of another embodiment of the necklace cover according to the present invention.
Figure 6:
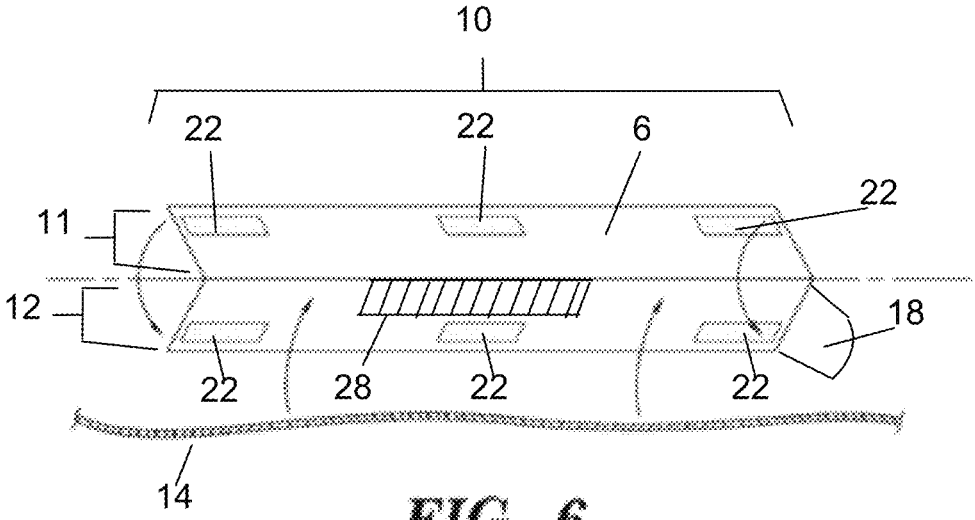
FIG. 6 is a perspective view illustrating a method of encasing a necklace in the necklace cover according to the present invention.
Figure 9:
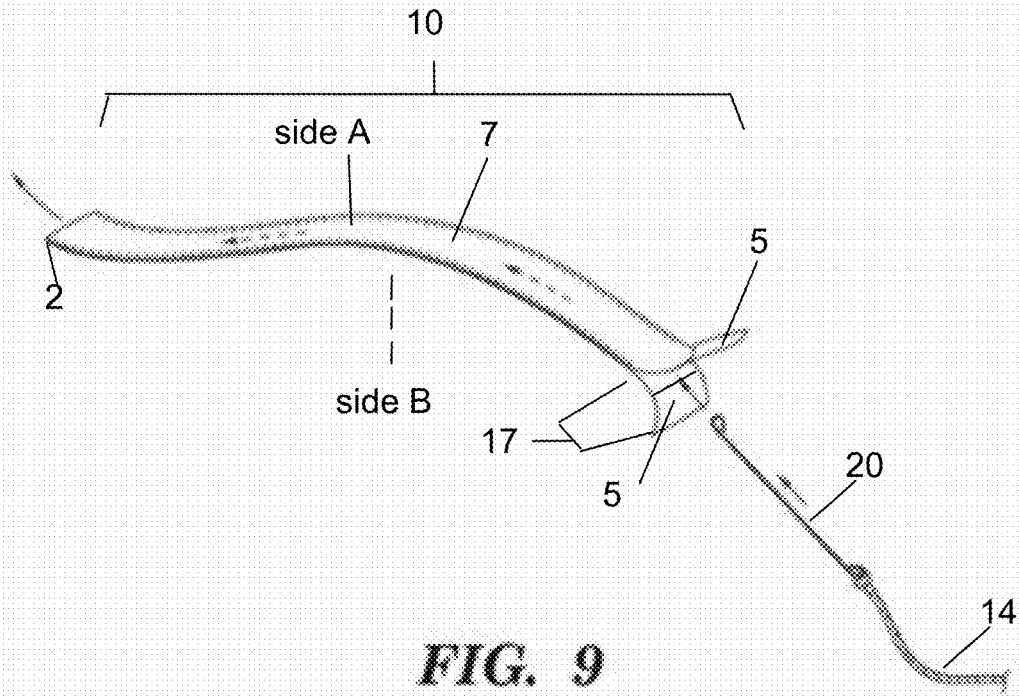
FIG. 9 is a perspective view illustrating another method of threading the necklace through the necklace cover according to the present of the invention.

Referring to FIG. 3, tubular member 7 can be formed from a single cut piece of material that is wrapped, folded and sewn or bonded (i.e. non-releasably attached) together to from a tube. As shown in FIG. 6, which will be described further herein, symmetrical shaped member 6 is folded along its longest axis of symmetry 13 and sewn or bonded to form a tube. Alternatively, the tubular member 7 can be formed from multiple cut pieces of material, or it can be initially woven, or manufactured as a tube, (in example, a shoelace material tube, or velvet tube). Referring to FIG. 9, when a tubular member lies flat, it has a side A and a side B that represents a top piece and a bottom piece of material, as it lays flat. Referring to FIG. 12, tubular member 7 can have an ornamental design 8, e.g. addition of decorative trims, lace design, beads, decorative fabric, as well as other ornamental designs. Referring to FIG. 12, tubular member 7 can have a decorative edge 9 that lies along the outside edge of the material member.

As used herein, a "symmetrical shaped material member" or "symmetrical shaped member" refers to any substantially symmetrical shaped material, i.e. natural or manmade, fabric, paper, or plastic, with at least one axis of symmetry. The symmetrical shaped member 6 can be a standard geometric shape such as an oval, square, rectangle, triangle, or a more unusual symmetrical shape e.g. a three leaf clover. The symmetrical shaped member 6 can have an ornamental design 8 on the material member, e.g. on top of the material, or it can have an ornamental design on its edges, i.e. a decorative edge 9, e.g. a material zig-zag edge, half-mooned scalloped edge, addition of decorative trims, or lace design, as well as other ornamental designs. The decorative edge need not be symmetrical.

As used herein, the term "jewelry composition" 14 refers to the material and design that is a piece of jewelry that can be worn around the neck, e.g. necklaces. Necklaces come in a variety of shapes and sizes; there are thousands of different types and materials. Non limiting examples include necklaces made of a string of beads; metal chains with or without ornamentation such as gold, silver, titanium, alloys, and precious and semi-precious metals; pearls; crystal; diamonds; gemstones; rope; string; plastic; leather; velvet; silk; and ribbons etc. Metal chains can be of any type, non-limiting examples include, a bead chain, a rolo chain, book chain, butterfly chain, cable chain, cuban chain, curb chain, figaro chain, figogucci chain, foxtail chain, herringbone chain, marina chain, mariner chain, panther link chain, san marco chain, serpentine chain, Singapore chain, omega chain, byzanitne chain, rope chain, snake chain, mesh chain, wheat chain and box/Venetian chain, and the like. Any jewelry composition 14 worn around the neck can be covered by the necklace covers 10.

The "symmetrical shaped material member" 6, or "tubular material member" 7, can be any flexible material known in the art, natural or man made, for example, plastic, vinyl, elastic, lycra, acetate, leather, lace, silk, velvet, wool, nylon, polyester, rayon, cotton, linen, taffeta, crepes, fleece, fur, paper, etc,. Furthermore, the material of the symmetrical shaped member 6, or tubular member 7 can be any blend or combination of materials. In one embodiment, the material used is flexible enough such that it substantially conforms to the shape of a neck when wearing. Thus, in one embodiment, the necklace cover 10 conforms to the shape of a neck of a wearer.

The material of the cover 10 can be of any ornamental design or color. For example, the material can be a skin tone color, that matches ethnic skin tones such as Caucasian, African American, Chinese, Indian, etc., or it can be transparent such as an organza fabric or transparent plastic polymers. Silver and gold toned color material having a shiny matte to match silver and gold jewelry can also be used.

Material of the symmetrical shaped member 6, or tubular member 7 may contain a design, such as embroidery or print, e.g. embroidered organza, jacquard, or material with pictures of ornamental objects e.g. flowers, striped or spotted material etc.

The material of the symmetrical shaped member 6, or tubular member 7 can also treated as to prevent snags, fraying or breakage of the material, e.g. coated with a polymer, or by attaching a snag free material to the underside of the material that will be in direct contact with the jewelry composition.

In one embodiment the material of the tubular 7, or symmetrical shaped member 6, of the necklace cover 10, is stretchy, such as stretchy rubber, elastomeric material, or a stretchable fabric. As used herein "stretchable" or "stretchy" material means that a material can be expanded in at least in one direction, without breaking and regains its original dimensions after release of tension. In one embodiment, the stretchable material conforms to the shape of any jewelry clasp that may be part of a necklace, or conforms to the shape of the necklace itself (for example a chain, or beaded necklace) as to inhibit the cover 10, from sliding along the piece of jewelry 14. Preferably the stretchable material retracts to its original shape/size after the material is stretched over a necklace clasp, bead, or chain (jewelry composition 14).

Fabrics that are stretchy are well known to those in the art. Suitable examples of fabrics that are stretchy include, but are not limited to, elasticized material, LYCRA™ blends (Du- Pont E.I. DuPont de Nemours and Co., Willmington, Del. U.S.A.), Spandex™ (DuPont), Neoprene™ (Dupont), elastane, spandura, cotton lycra, supplex lycra, wicking lycras, regulator fleece, stretch spandex, stretch velvet, stretch vinyl, italian nylon, silky satin, stretch equestrian lycra, neoprene, stretch silk, nylon spandex, and the like. Some stretchy fabrics are described in U.S. Pat. Nos. 6,698,252 (swim fabric resistance to snagging with relatively uniform stretchability in widthwise and lengthwise directions); U.S. Pat. No. 4,340,537; U.S. Pat. No. 163,871; and U.S. Pat. App. No. 2005044897, each of which are herein incorporated by reference.

Nonwoven laminates, such as stretchable film are also useful materials of the invention. Suitable stretchable polymers for making stretchable film and fabric include stretchable olefin fibers such as an olefinic copolymer of polyethylene. More specifically, other stretchable polymers include diblock, triblock, tetrablock or other multi-block elastomeric copolymers such as olefinic copolymers, including styrene-isoprene-styrene, styrene-butadiene-styrene, styrene-ethylene/butylenestyrene, or styrene-ethylene/propylene-styrene, which may be obtained from the Shell Chemical Company, under the trade designation Kraton™. elastomeric resin; polyurethanes, including those available from E.I. Du Pont de Nemours Co., under the trade name Lycra™; polyurethane; polyamides, including polyether block amides available from Ato Chemical Company, under the trade name Pebax™, polyether block amide; polyesters, such as those available from E.I. Du Pont de Nemours Co., under the trade name Hytrel™, polyester; and single-site or metallocene-catalyzed polyolefins having density less than about 0.89 grams/cc, available from Dow Chemical Co. under the trade name Affinity™.

Examples of suitable types of laminates include a melt-blown laminate, a stretch-thermal laminate (STL), a neck-bonded laminate (NBL), a reversibly necked laminate, or a stretch-bonded laminate (SBL) material. Methods of making such materials are well known to those skilled in the art and described in U.S. Pat. No. 4,663,220 issued May 5, 1987 to Wisneski et al.; U.S. Pat. No. 5,226,992 issued Jul. 13, 1993 to Morman; and European Patent Application No. EP 0 217 032 published on Apr. 8, 1987 in the names of Taylor et al.; all of which are incorporated herein by reference. Alternatively, the stretchable material may include other woven or non-woven materials.

The material of the symmetrical shaped member 6, or tubular member 7 can also be any fabric known in the art. Some example fabrics that are suitable for the symmetrical shaped member 6, or for the tubular member 7, of the necklace cover 10 include, but are not limited to, fabrics made of wool, linen, silk, cotton, polyester, velvet, satin, lace, and rayon and combinations thereof.

It should be understood that any type of flexible material whether it be plastic, other polymers, or fabric can be used for the material of the symmetrical shaped 6 or tubular member 7. In one aspect the flexible material is fabric. Furthermore, the material can be a single layered or multi-layered material. In one embodiment, color fast materials are used.

Fabrics can be ribbon, or fabrics obtained straight from the bolt in flat or panel form or it can be pleated, pin tucked, gathered or otherwise manipulated, thus providing additional ornamental effect. A multitude of ribbons, ribbon tapes and material tubes are commercially available.

The fabric can be treated so it does not fray. Means for preventing fraying in fabrics are known to those in the art, e.g. edges of the fabric can be sewn with a ziz-zag stich, hemed, covered with folded material, glued, or treated with compositions such as Fraycheck™, and the like. The fabrics can be further treated along the interior of the necklace cover 10 (e.g. along lumen) to prevent snags or pulls from occurring from contact with the jewelry composition.

As used herein, the phrase "adapted to cover a jewelry composition" means that the tubular member 7 has two open ends 2, 3 and lumen 4, whose circumference is large enough to allow the jewelry composition 14 to be threaded through the lumen 4, but not so large as to be uncomfortable to the wearer. The internal circumference of the hollow center, or size of the lumen is dependent upon the size of the jewelry composition 14 (e.g. chain, bead, or pearl etc.), or on the size of the jewelry clasp, to be covered. The internal circumference should be large enough to cover any jewelry clasp that may lie at the back of the neck of the wearer. Examples of various sizes of the tubular member 7 and lumen 4 are described herein. Tubular member 7 is further designed such that it can be moved by the wearer back and forth along the jewelry 14 when force is applied. As such, tubular member 7 can be positioned at the back of the neck 15 of the wearer upon wearing the jewelry 14, e.g. a necklace. Thus, the tubular member 7 is adapted to slide over the jewelry composition 14, as well as the jewelry clasp, if a clasp lies at the back of the neck 15 of the wearer. In the case of a metal chain, the jewelry clasp may be wider than the necklace chain. Some non-limiting examples of jewelry clasps include, spring ring clasps, lobster claw clasps, box clasps, box clasps with safety guards, toggle clasps, hidden clasps, decorative clasps, and magnetic clasps. Tubular member 7 can either snuggly or loosely fit over the jewelry 14 as long as it slides over jewelry composition 14 and/or clasp when force is applied. A snug fit can be achieved when the Tubular member 7, for example, is made of stretchy material. Tubular member 7 can also be designed to conform to the shape of the neck of a wearer as it is designed to comfortably lie at the back of the neck 15, e.g. fabrics naturally conform to the shape of the neck of the wearer.

Figure 14:
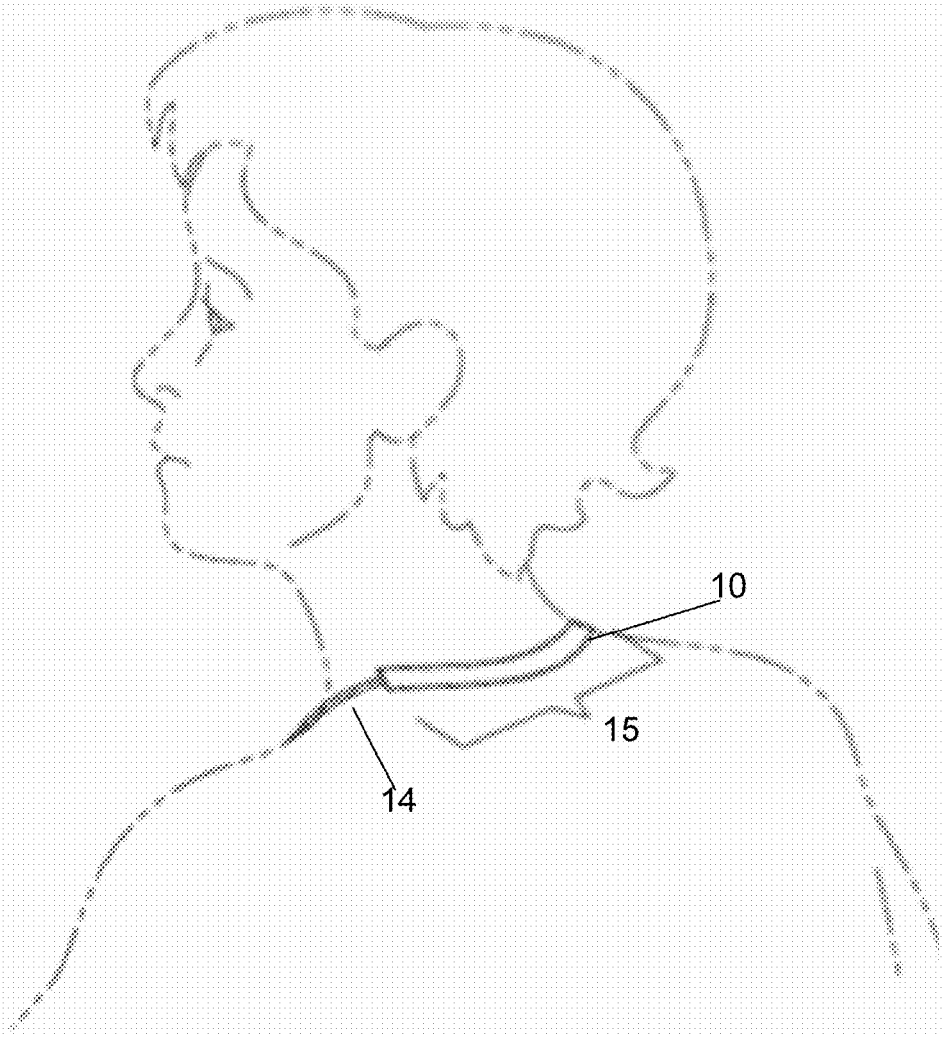
FIG. 14 is a perspective view illustrating a necklace cover according to the present invention being used by the wearer. The necklace cover covering the necklace is positioned at the back of the neck of a wearer.

The necklace cover 10 is worn by the wearer by threading the jewelry composition 14 to be worn around the neck through the cover 10, wearing the jewelry 14, then sliding the cover 10 along the jewelry composition 14 such that it lies at the back of the neck 15 (See FIG. 14).

Figure 16:
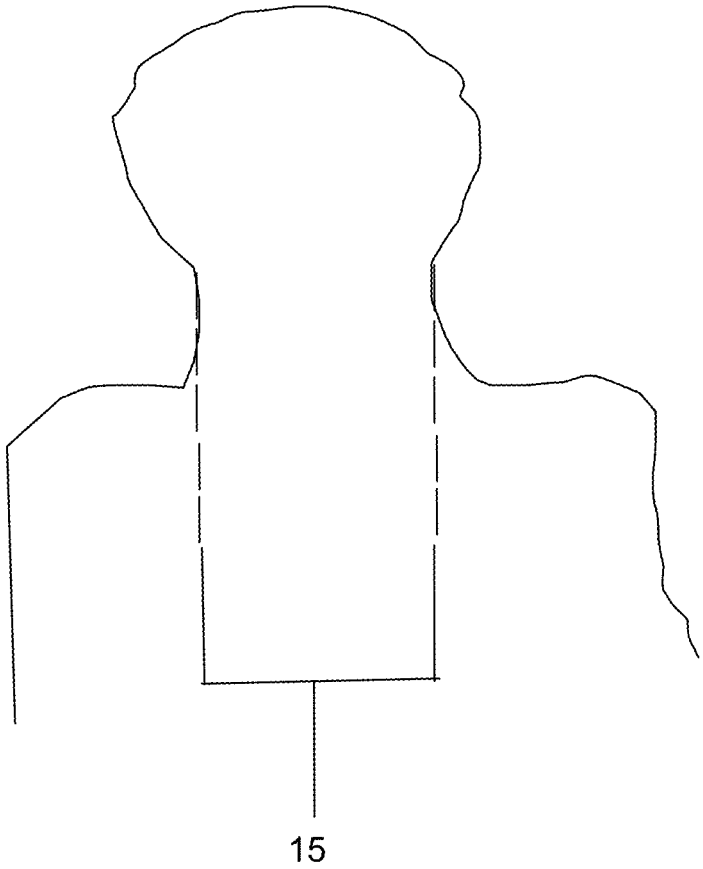
FIG. 16 is a perspective view illustrating the back of the neck of a wearer.

The phrase "at a point where said jewelry composition 14 lies at the back of the neck 15 of the wearer" refers to any point along the jewelry composition 14 that lies at the back of the neck 15 of a person when the jewelry is worn by the person around the neck. The region of the jewelry 14 that lies at the back of the neck 15 may include the necklace clasp. The region of jewelry 14 that lies at the back of the neck 15 of the wearer is dependent upon the size of the neck of the wearer and can be measured by measuring the distance between two parallel points on an imaginary line drawn vertically down from the neck to the back. See FIGS. 14 and 16 for a diagrammatic representation of the back of the neck 15 of a wearer.

As shown in FIGS. 8-11, and 13, tubular member 7 can also include at least one fastener means 5 for securing the necklace cover 10 along the jewelry composition 14 to aid in preventing the cover 10 from sliding along the jewelry 14 when no force is applied.

Fastener means 5 for securing the necklace cover along the jewelry 14 can lie either at the first end 2 or the second end 3 of the tubular material member 7 or can lie at any region along the length of the tubular member 7, or it can be positioned anywhere on the inside of the tubular member 7. For example, fastener means 5 for securing the necklace cover 10 along the jewelry composition 14 can be positioned at the center of the tubular member 7, which typically would be the point where a jewelry clasp may lie when the tubular member 7 is positioned at the back of the neck 15.

Two fastener means 5 for securing the necklace cover 10 along the jewelry composition 14 can be used. For example, a fastener means 5 for securing the necklace cover 10 along the jewelry 14 can positioned at each end of the tubular material member, i.e. at the first end 2 and at the second end 3.

Fastener means 5 for securing the necklace cover along the composition 14 that can be used for necklace cover 10, include, but are not limited to, hooks, snaps, buttons, hook and loop material such as Velcro™, adhesive material, re-attachable adhesive, ties, elastic, magnets, (e.g. magnetic strips, or stronger magnets), or any other suitable fasteners and any combination thereof. Fastener means 5 may have a male and female member, e.g. hook and ring, or eyelet and loop, button and button hole, etc. Fastener means such as magnets and adhesive can have equivalent male/female members. The fastener means 5 can also be any type of clip or clasp, e.g. fold over clasp, a spring clasp, a clasp that opens by squeezing hinged ends (e.g. vintage change purse style clasp), a plastic or metal clip, or a lanyard style cord fastener, or twist ties.

Figure 12A:
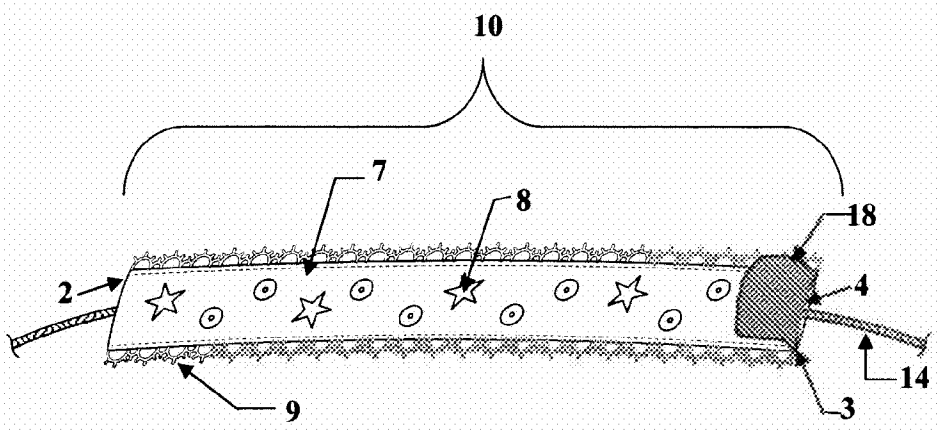
FIGS. 12A and 12B are a perspective view of yet another embodiment of the necklace cover according to the present invention.
Figure 12B:
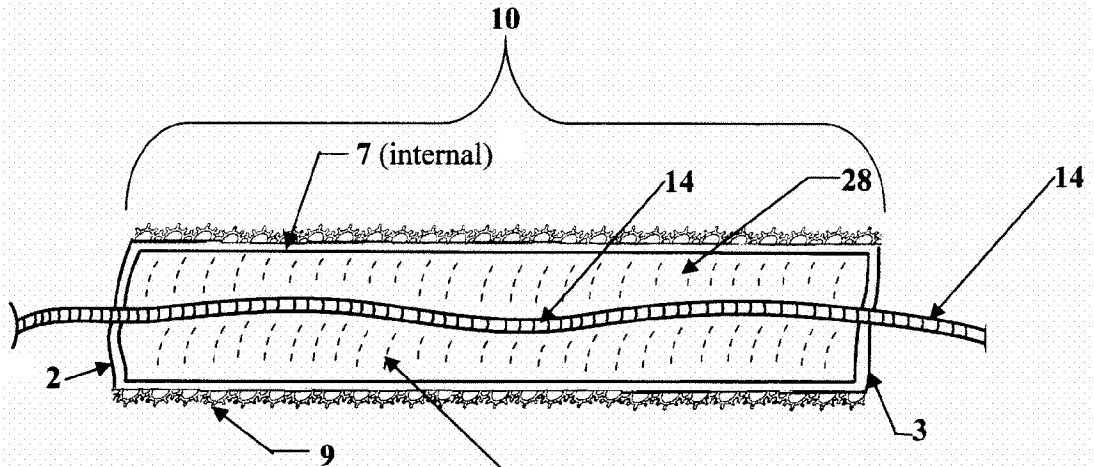

In one aspect a slip resistant material 28 placed on an inside point of the cover 10 such that it "grips" the jewelry composition 14 substantially preventing sliding of the necklace cover 10 along the jewelry composition 14 when no force is applied, see for example FIGS. 12A and 12B, FIG. 12B being the interior view of FIG. 12A. It should be understood that the slip resistant material 28 need not be placed on the entire interior of the necklace cover 10. It can be placed at any point on the inside of the cover 10 along the lumen of the tubular member 7, or interior portion of the symmetrical shaped member 6. The slip resistant fastener means 28 need only to be placed on one interior side of the tubular member 7, or can be placed on both interior sides anywhere along the lumen.

The term "slip resistant material" 28 is intended to encompass any material that prevents sliding of the necklace cover 10 along the jewelry composition 14. A material is slip resistant if it prevents sliding of the necklace cover 10 along the jewelry composition 14 without an applied force, e.g. pulling or pushing the cover 10. For example, if one were to hold a jewelry composition 14 that has been threaded through, or encased by, a necklace cover 10 having slip resistant material 28 vertically, such that the necklace cover 10 is also vertical, and the necklace cover 10 does not substantially slide downward along jewelry composition 14 due to gravity, the material is slip resistant. In addition, if one were to wear the cover 10 having slip resistant material 28 at the back of the neck over the jewelry composition 14 and the cover 10 does not substantially slide along the jewelry composition 14 without pushing or pulling the cover, then the material is slip resistant.

Slip-resistant material suitable for gripping the jewelry composition 14 include, but are not-limited to, elastomers (natural or synthetic), rubber materials, polymeric material e.g., Dycem™ materials (Dycem limited corporation, Bristol England) made from polyvinylchloride compounds that have a non-migratory plasticizer (available from Dycem limited Ashley Hill Trading Estate Bristol, Bristol England BS2 9XS) or polymer compositions such as the polymeric material often used to hold thigh high stockings on the skin of the wearers thigh. The polymeric materials can be rubber-like materials including natural rubber and synthetic polymers that have a high coefficient of friction to the jewelry composition 14 and/or skin and are of low hardness, examples of polymeric materials include acrylic polymers, vinyl chloride polymers, foamed elastomeric materials, cured polydimethyl-siloxane, vinyl chloride/vinylidene chloride polymers, vinyl chloride/acrylic polymers, butadiene/acrylonitirile polymers, vinyl acetate/acrylic polymers, styrene/acrylic polymers, carboxylated styrene/butadiene polymers, styrene/butadiene polymers, vinylidene chloride/acrylic polymers, ethelene/vinyl acetate polymers, ethylene/ethyl acrylate polymers,ethylene/methylacrylate polymers, styrene/butadiene/styrene polymers, styrene/isoprene/styrene polymers, poly vinyl ethyl ether, and conventional thermoset elastomers of natural rubbers, polyisoprene, butadiene, chlorosulfunated polyethylene nitrile, poly acrylates, urethanes, chloroprenes, chlorinated ethylenes, polymerized siloxanes, coated or cured polymerized siloxanes, dimethylvinylsiloxane, and the like. The slip resistant material 28 can be urethane based as described in U.S. Pat. No. 3,728,875, herein incorporated by reference, or can be crosslinked oligomeric diols, e.g. a material based 95 to 99.8% by weight, a polyadduct based on a polytetramethylene oxide diol, 1,4-butanediol and 4,4'-diphenyl-methane diisocyanate, the weight fraction formed from polytetramethylene oxide diol and 4,4'-diphenylmethane diisocyanate being greater than 78% by weight and the molar ratio of 4,4'-diphenylmethane diisocyanate to the sum of polytetramethylene oxide diol and 1,4-butanediol being between 0.96 and 1.01, as described in U.S. Pat. No. 6,673,421, herein incorporated by reference. Slip resistant materials 28 are further described in U.S. Pat. Nos. 3,975,925; 6,871,516; 3,983,870; and 3,728,875, herein incorporated by reference in their entirety.

The polymeric material, for example, can be applied to the material member 6 or 7 by spraying a fine mist of a solution or latex of the polymeric material onto the material member 6 or 7, See for example as describe in U.S. Pat. No. 3,983,870 herein incorporated by reference. When spraying, the viscosity of the polymeric material solution is adjusted so that the particles of the polymeric material partially dry while in transit to the material member 6 or 7, typically (about 5-15% solid content by weight). The polymers can be plasticized if necessary to obtain a rubbery high coefficient of friction type polymer. Polymeric material can also be applied by dipping the part of the material member 6 or 7 that will contact the jewelry composition 14 into the polymeric material, or brushing or rolling the polymeric material onto the inside region of the cover 10. Slip resistant material 28 can also be sewn or glued etc. onto the inside of cover 10. A slip resistant knitted lace fabric with oleophoboic and hydrophobic plastisol is described in U.S. Pat. No. 6,871,515, herein incorporated by reference. A slip resistant ribbon is described in FR2609889, herein incorporated by reference in its entirety.

The fastener means 5 used herein can be attached by any manner known to a person in the art, including, but not limited to, bonding, sewing, thermocompression, adhesive tape, and the like. The fastener means 5 for securing the necklace cover along the jewelry composition 14 need not entirely prevent the sliding of the cover along the jewelry composition 14 when no force is applied. The fastener means 5 can inhibit, or slow, any sliding motion of the necklace cover 10 along the jewelry 14 that would occur in the absence of such a fastener means 5, when no force is applied.

In one preferred aspect, a slip resistant material 28 is placed on an inside of the necklace cover 10, made of flexible fabric, along the lumen 4. Referring again to FIG. 12B showing the internal view of the necklace cover of FIG. 12A, the slip resistant material 28 need not be placed to cover the entire inside of the necklace cover 10, but can placed over only a portion of the inside of the cover 10, anywhere along the length of the cover 10. Slip resistant material 28 can an inhibit, or slow, any sliding motion of the necklace cover 10 along the jewelry 14 that would occur in the absence of such slip resistant material 28, when no force is applied.

In another embodiment, the male and female members of the fastening means 5 are placed on the interior side of the tubular member 7 on opposite sides of at least one end (first or second end) of the material tubular member 7, See FIG. 9.

The fastener means 5 can also be an extension of the tubular shaped member 7 and is attached to the outer edge of at least one end of the tubular member.

Figure 8:
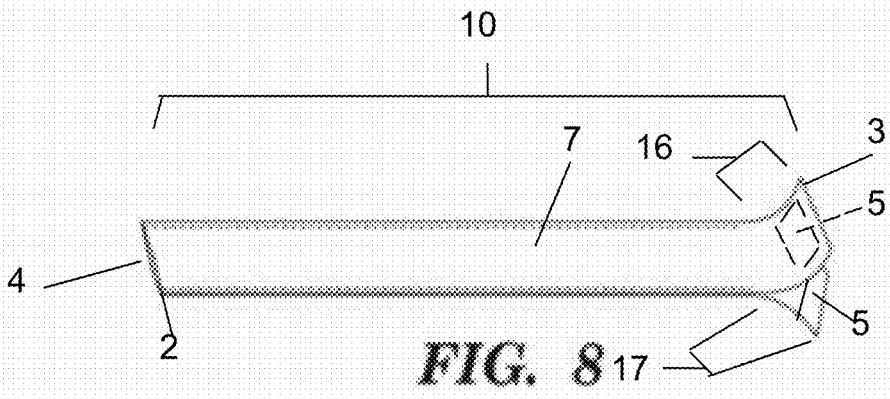
FIG. 8 is a perspective view of another embodiment of a necklace cover according to the present invention.

Referring to FIG. 8, the tubular material member 7 can be formed from two rectangular pieces sewn, or bonded together such that two flaps (flap 16 and flap 17) are formed at, at least, one end of the tubular member. In this manner, for example, the fastener means 5 male member can be attached to the inside of flap 16 and the fastener 5 means female member attached to the inside of flap 17. Accordingly, to secure the tubular member 7 along the jewelry 14, flap 16 can be attached to flap 17 by fastening the male and female member to each other. The presence of the flap can also aid in threading of the jewelry 14 through the tubular member 7, allowing the fastener means 5 to be moved out of the way of the jewelry 14 while threading, see FIG. 9. The flaps can also serve as tabs, making it easier for the wearer to pull the cover or sleeve 10 to the back of the neck 15 prior to fastening the cover 10 along the jewelry 14. Flaps can also be made by creating a cut in preformed tubular members 7, as to create a flap 16 and a flap 17. Although a tubular member 7 can be formed of rectangular shaped material members, as shown in FIG. 8, any symmetrical shaped member 6 can be similarly used. Furthermore, referring to FIG. 12, flaps 16, 17 need not be used.

As described above, fastener means 5 for securing necklace cover 10 along the jewelry composition 14 can be a magnet. A magnet fastener means 5 on the symmetrical 6 or tubular member 7 allows for the magnet to adhere to the metal jewelry as well as other magnets. In one embodiment, a magnet that has an indentation that is used to allow the jewelry chain 14 to lie inside the indentation when the magnet fastener means 5 is closed.

Fastener means 5 for securing necklace cover 10 along the jewelry composition 14 can also be Velcro™. A Velcro™ fastener means 5 allows for the Velcro hooks and loops to surround the jewelry composition 14 securing the cover along the jewelry.

Fastener means 5 can also be folded over clasps or clips that create a tight hold of the cover over the jewelry 14. Snaps can also be positioned in a manner to secure the cover along the jewelry 14, creating a tighter fit around the jewelry composition 14. Adhesive fastener means 5 have tackifiers that can bond the jewelry and secure the cover 10 along the chain.

Figure 13:
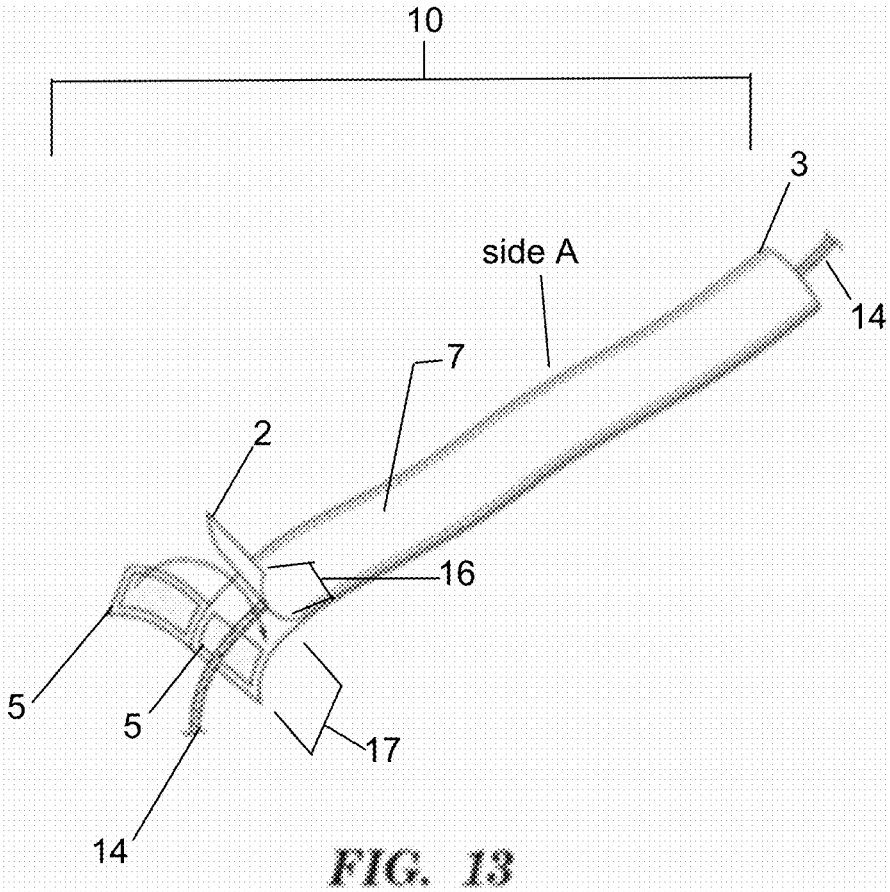
FIG. 13 is a perspective view of still yet another embodiment of the necklace cover according to the present invention.

Fold over clasps fastener means 5 can be attached by securing the bottom part of the fold over clasp, to either the inside or outside of the tubular member 7 on one side (e.g. side B) of at least one end of the tubular member 7. See FIG. 13. Alternatively, a piece of the tubular member 7 can be folded over the bottom part of a fold over clasp, on one side (e.g. side B) of at least one end of tubular member 7, securing the bottom part of the clip, or clasp, within one side of one end of the material of the tubular member 7. As shown in FIG. 13 the clasp is secured to flap 17 and the top part of the fold over clasp or clip is then clamped over, in the following order a) flap A material 16, b) the jewelry chain, bead, or string etc, (jewelry composition 14) and c) the bottom part of the clasp on secured to flap 17 for securing the sleeve or cover 10 along the jewelry 14. It should be understood that the above are merely examples and that fold over clasps can be attached by any means.

In another embodiment, the clips, or fold over clasps, that are used as fastener means 5 are not physically attached to the tubular member 7 (or symmetrical shaped member 6), but clipped or clasped at either, or both ends, of the tubular material member (or symmetrical shaped member). They can also be clipped or clasped at other regions along the necklace cover 10 (e.g. at the center over the clasp).

Fastener means 5 for securing necklace cover 10 along the jewelry composition 14 can also be a re-attachable pressure sensitive adhesive material placed on the inside of the necklace cover 10, e.g. the material used in Post-It™ notes, available from 3M Innovative Properties Corporation (U.S. Pat. No. 3,691,140), or re-attachable adhesives having tackiness such as those disclosed in U.S. Pat. Nos. 4,684,685; 5,389,438; 5,827,591; 4,755,550; which are all herein incorporated by reference.

Figure 19:
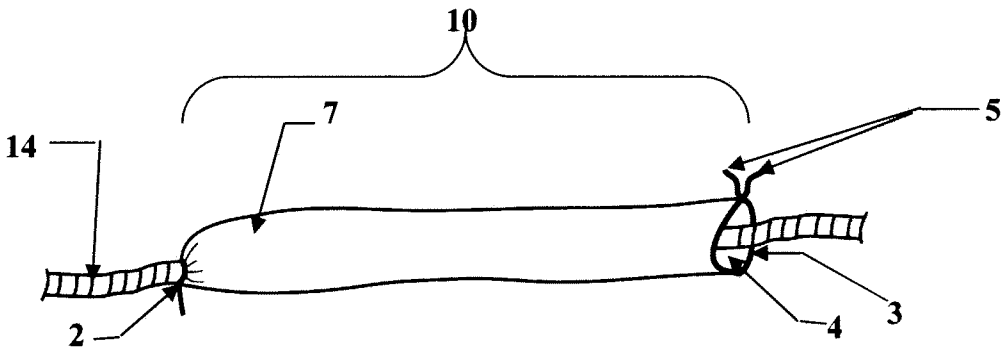
FIG. 19 is a perspective view of another embodiment of the necklace cover according to the present invention.

Referring to FIG. 19, at least one of the open ends of the tubular member 7 can be elasticized, e.g., having a stretchable elasticized fastener means 5 ring around the circumference of the ends such that the stretchable rings hold the cover 10 along the necklace so the cover 10 does not readily slide along the jewelry 14 when no force is applied. Referring again to FIG. 19, the cover 10 can include a fastener means 5 that is a string the can be pulled or tied to hold the necklace cover 10 in place. A string fastener means 5 may be sewn around the circumference of the tubular member 7 using means known in the art such that when the string is pulled material gathers and tightens around the jewelry composition 14.

It should be noted that any number and combination of fastener means 5 can be used in the necklace cover 10 of the invention.

The necklace cover 10, may further include ornamentation 8, for example jewels, stones, acrylic or glass jewels, lace, decorative wood, metal, beads, and the like. Ornamentation 8 can be placed anywhere on the necklace cover 10, e.g. anywhere along the outside of the cover or on top of fastener means 5. See for example FIG. 12A.

In one embodiment, the necklace cover 10 includes ornamentation 8 that is positioned over the fastener means 5, or positioned over the material that may lie over the fastener means 5 (e.g. when a magnetic strip, Velcro™, or snaps are used as a fastener). Many decorative ornamental items are available from jewelry maker suppliers.

The necklace cover 10 has been illustrated as covering a large region of the jewelry composition 14 that lies at the back of the neck. However, the necklace cover 10 can cover only the jewelry clasp, for example, being of only of about 2 cm to about 3 cm in length. In another embodiment, the necklace cover 10 covers about 5%-100%, or about 75% to about 100% of the region of jewelry 14 that lies at the back of the neck 15 of a wearer. The region of the back of the neck can be measured by measuring the distance between the farthest two points on the neck where a vertical line can be drawn down to the back (See FIG. 16).

The necklace cover 10, can be designed to slide over any jewelry 14 that is worn around the neck (necklaces), e.g. metal chains of various width or chain link size, beaded necklaces, pearls, stones, etc. The size of the cover 10 is dependent on the circumference size of the part of the necklace that is to be covered. It should be understood that necklace covers 10 designed for children will be generally smaller in size, especially in length.

The size of the lumen 4 of the necklace cover can vary dependent on the style of necklace to be covered, for example a beaded necklace may require a larger necklace cover, for example about 10 mm-30 mm lumen 4 flat width. For a thin metal chain the lumen could be smaller, for example 1 mm-10 mm flat width. Some jewelry have jewelry clasps and clasp extensions that are thinner than the rest of the jewelry composition 14 and it may be desirable to cover only the jewelry clasp with jewelry clasp extension.

In one embodiment, when the tubular member 7 lies flat, the measured width of the lumen 4 is about 2 mm to about 30 mm. It should be appreciated that the recitations of the ranges described herein (i.e. throughout the entire specification) are intended to include all intervening numerical values in the alternative.

The symmetrical shaped member 6, or tubular member 7 can be of any length. In one embodiment, the length of the symmetrical shaped material member 6, or tubular material member 7 is at least about 3 cm. In one embodiment, the length of the symmetrical shaped material member 6, or tubular member 7, ranges from about 2 cm to about 16 cm. In one embodiment, the length of the symmetrical shaped material member 6, or tubular member 7, ranges from about 2 cm to about 12 cm. In one embodiment, the length of the symmetrical shaped material member 6, or tubular member 7 ranges from about 3 cm to about 10 cm.

As described above, tubular member 7 can comprise a symmetrical shaped member 6 that is folded along its longest axis of symmetry then sewn or bonded together by another means to form the tubular member 7 with a lumen. As used herein, the term "longest axis of symmetry" 13 refers to the axis of symmetry that lies along the length of the symmetrical shaped member, see for example FIG. 6, reference 13 being the longest axis of symmetry. The axis of symmetry creates symmetrical portion 11 and symmetrical portion 12. When the symmetrical shaped member 6 is folded along its' longest axis of symmetry 13, symmetrical portion 11 can be sewn or bonded to symmetrical portion 12. As used herein, the term "bonded" is intended to mean non-releasably attached together, e.g., glued, fused, melted together, fastened with non-releasable fastener or hemming tape, etc. Symmetrical portion 11 and symmetrical portion 12 are sewn or bonded together such that the desired width of the lumen 4 is obtained for the tubular member 7.

Tubular member 7 can formed by sewing, or bonding, two symmetrical shaped member 6 pieces together, as shown in FIG. 12. Tubular member 7 can be turned inside out after sewing resulting in physical appearance of a tube, alternatively, the tubular material member can be left alone (i.e. not turned inside out).

Tubular material member 7 can further include decorative edges 9 along the length of the material member, for example any decorative trim, as half moon scallops, lace, and the like, see FIG. 12. A multitude of decorative trims are available in the art, for example even gold rope or fur etc. could be used.

Figure 20:
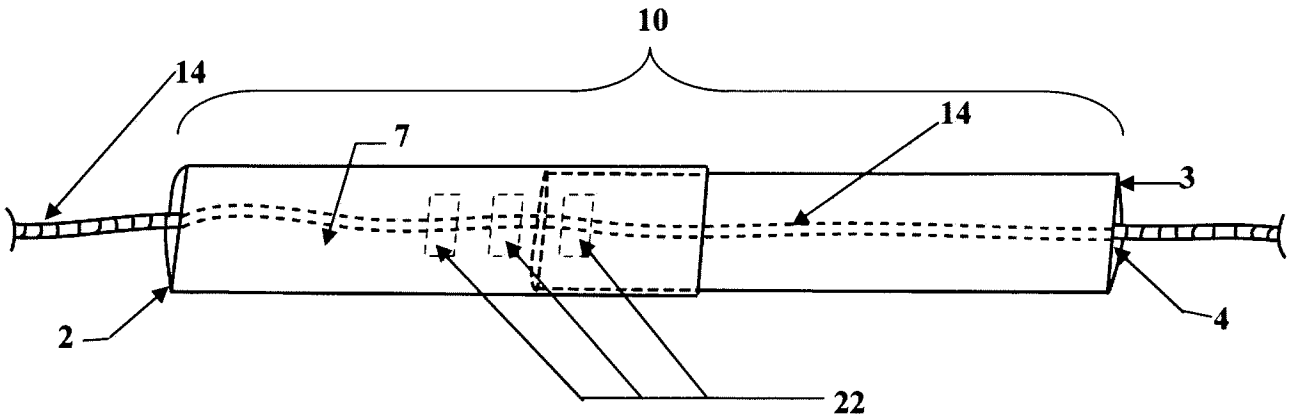
FIG. 20 is a perspective view of yet another embodiment of the necklace cover according to the present invention.

More than one tubular member 7 can be used to create the necklace cover 10, e.g. two tubular members 7 that slide over one another can be used to form necklace cover 10 of adjustable length, see for example FIG. 20. Referring again to FIG. 20, tubular members 7 have an attachment means 22 for releasably connecting the tubular members to one another in order to form a tubular member 7 of adjustable length.

The necklace cover 10, may be disposable. By "disposable" is meant that the necklace cover 10 is to be used for a limited number of uses, e.g. designed with an adhesive where the adhesive wears over time and usage (e.g. adhesive can be used as a fastener means 5 for securing the cover along the jewelry composition, or for an attachment means 22 when asymmetrical shaped member is used), or designed with a material that can only be used for a limited period of time before tearing.

As described above, necklace cover 10, may include a means for pulling the tubular material member across said jewelry composition 14, referred to as 18, such that the necklace cover 10 can be positioned at the back of the neck of the wearer. Means 18 for pulling tubular material member 7 across the jewelry composition 14 include a tab, pull, or string positioned on the cover 10 (e.g. at least one end of 6 or 7) such that the wearer can grab onto the tab or sting to forcibly slide/pull the tubular member 7 along the jewelry composition 14 including any clasp of the necklace. Means 18 can be deposited on any region of the cover 10, as long as it can be easily grabbed, e.g. between an index finger and thumb, and pulled by the wearer when wearing the necklace 14 and cover 10. Means 18 can be of any shape or size and made of any material (e.g. fabric, wood, plastic, yarn, beads, see also e.g. materials listed throughout the specification in description of material members) (for a non-limiting examples, see FIG. 1 and FIG. 6). The tab or string should be fashioned to easily fit between the fingers so the wearer can grip and pull necklace cover 10 after wearing jewelry composition 14.

The necklace cover 10 comprising at least one tubular member 7 can be worn by a person by first threading the jewelry 14 to be covered through the tubular member 7. The jewelry 14 is then worn around the neck as usual and the necklace cover 10 is positioned to lie at the back of the neck 15 of the wearer.

Any means to thread the necklace through the necklace cover can be used. Suitable threading means, "threaders" or "necklace cover threaders", for threading the jewelry 14 through the member, include, but are not limited to, a metal wire or plastic "wire" with at least one looped or hooked end where part of a necklace clasp can be attached or slided onto the loop or hook (pull through threaders, 20).

The necklace cover threader has a blunt end that will not puncture the material of the necklace cover 10 when being passed through the cover 10. In one embodiment, the pull through threader 20 has one looped and one hooked end, or two looped ends, or two hooked ends, see for example, FIG. 9. When a loop is used, the loop need not be continuous, e.g. it can have an opening where part of the necklace clasp can be slipped onto.

Threaders are thin enough to pass through the necklace cover 10 and stiff enough to be passed through the necklace cover 10 without bending, e.g. bending back on itself. The width or circumference of the necklace cover threader can vary, as long as it can be passed through the tubular member 7. Preferably, the length of the threader is longer than the length of the necklace cover 10 to be threaded.

The pull through necklace cover threader 20 can be an object, for example, metal, wood, plastic or any other material having a first and second end, wherein the first end has a means for attachment of the necklace (e.g., a hook, or loop, or a hole, or a wrap around indentation) and the second end is a blunt end, wherein the object has a width that is able to pass through the lumen 4 of the necklace cover 10.

Figure 2:
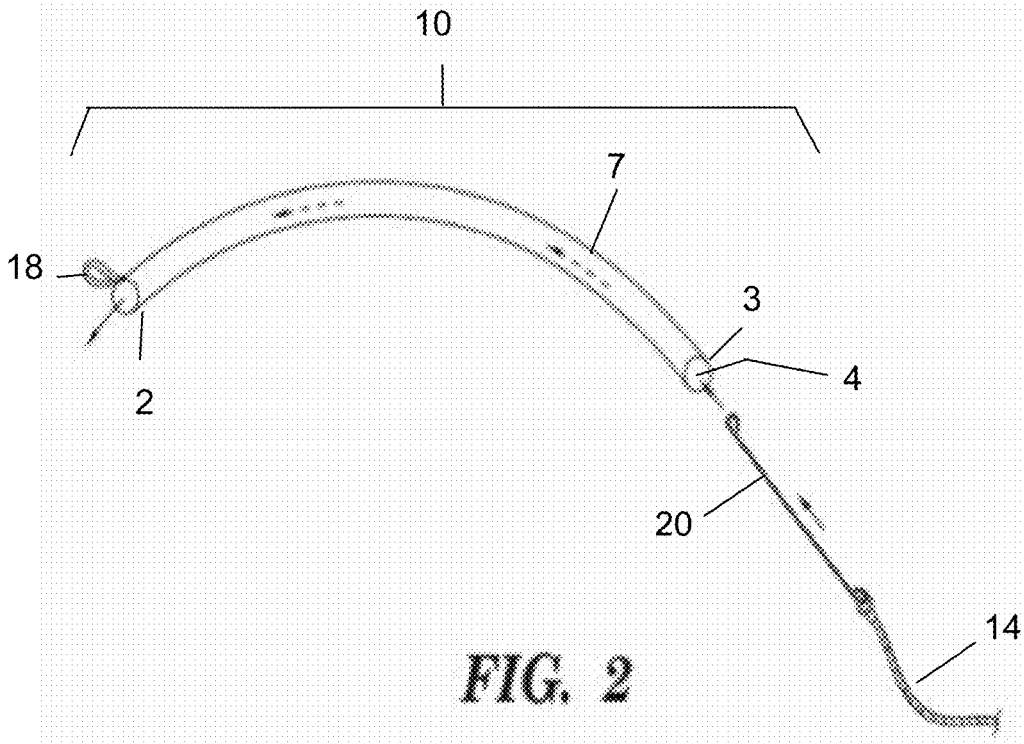
FIG. 2 is a perspective view illustrating a method of threading the necklace through the necklace cover according to the present invention.

The jewelry 14 is threaded by attaching the necklace to one end and putting the end of the pull through threader 20 to which the jewelry 14 is not attached through the tubular member 7, See FIG. 9 and FIG. 2). Jewelry 14 is then pulled through the member and detached from the threader.

Figure 10:
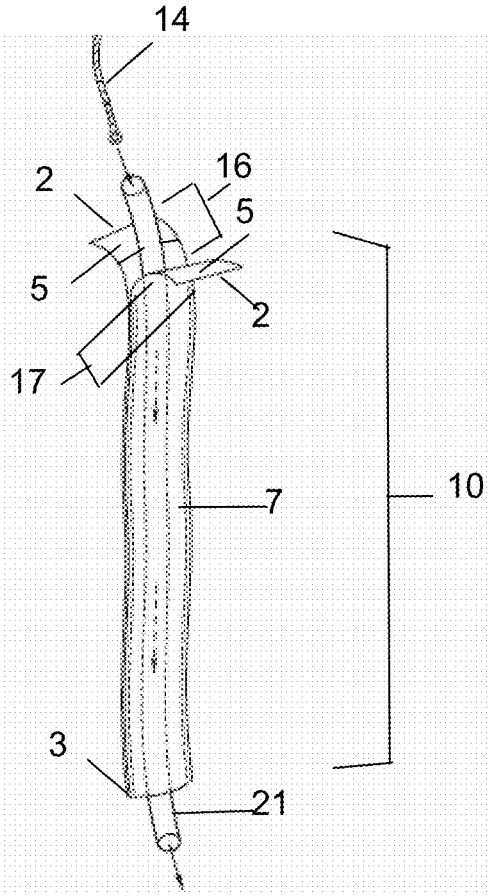
FIG. 10 is a perspective view of yet another method of threading the necklace through the necklace cover according to the present of the invention.
Figure 11:
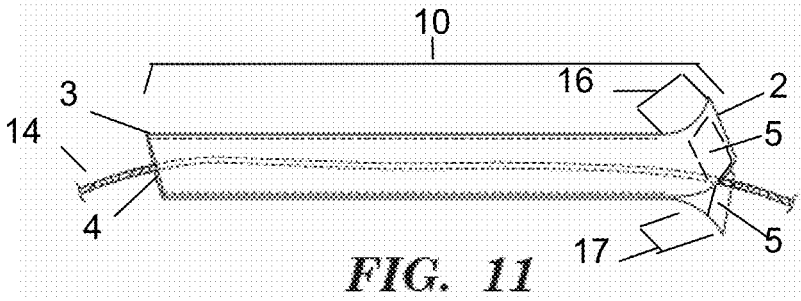
FIG. 11 is a perspective view of another embodiment of the necklace cover according to the present invention.

Necklace cover threader can also be a stiff hollow tube threader 21 having two open ends that can be inserted through the openings of the tubular member 7, the jewelry 14 can then be dropped through the stiff tube within the tubular material member 7, See FIG. 3 and FIG. 10. The stiff hollow tube 21 can then be removed, slid out of the tubular member 7 and off the jewelry composition 14, leaving the jewelry 14 behind, See FIG. 4 and FIG. 11. Stiff hollow tube 21 can be longer than the tubular member 7. The stiff hollow tube 21 can be made of any natural or synthetic material composition such as wood, plastic, rubber, metal, stiff leather, etc.

Stiff hollow tube 21 can have a pointed end that aids placing the tube 21 inside the necklace cover 10. One end of the hollow tube 21 is cut with a diagonal cut to create the pointed end. The pointed end can be a cone shape, e.g. the opening of the pointed end has a smaller circumference than the non-pointed end opening. In one embodiment, the stiff hollow tube 21 has a blunt end cover that can be slipped on and off the end of the stiff hollow tube.

Figure 21:
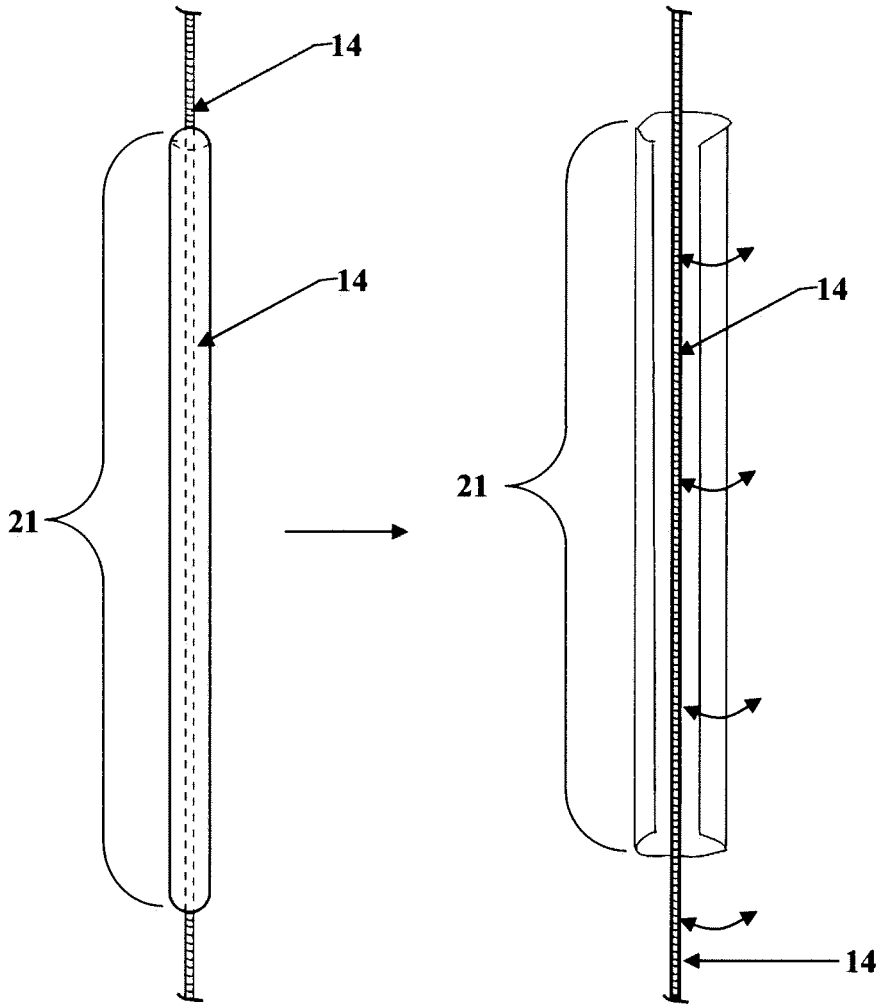
FIG. 21 is a perspective view of a stiff hollow tube necklace cover threader.

Referring to FIG. 21 stiff hollow tube 21 can have a cut (slit) down one side, such that the stiff hollow tube 21 can be pulled apart and pulled away from the jewelry 14. In this manner, the necklace cover threader can be removed after wearing the jewelry 14.

Jewelry 14 can be threaded through the necklace cover 10 using both the stiff hollow tube 21 and the pull through necklace cover threaders 20, e.g. the pull though threader 20 with hooked jewelry is dropped through the stiff hollow tube 21.

Figure 5:
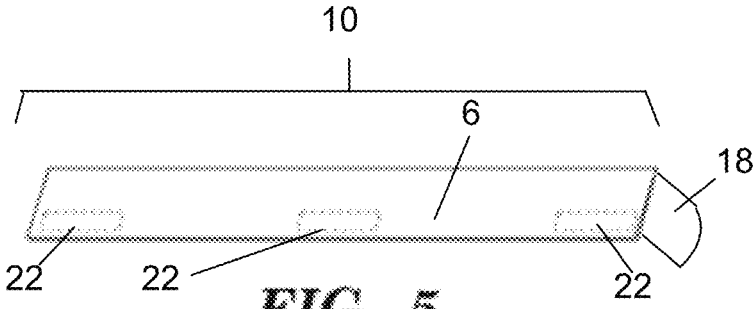
FIG. 5 is a perspective view of yet another embodiment of the necklace cover according to the present invention.

Referring to FIG. 5, necklace cover 10 does not require the necklace to be threaded through. Covers 10 are worn by the wearer by folding the cover 10 over, or wrapping the cover around, the jewelry composition 14. The necklace cover 10, is formed from a symmetrical shape member 6 that has an attachment means 22 for releasably connecting symmetrical portion 11 to symmetrical portion 12, see for example see FIG. 6. Symmetrical portion 11 is folded onto symmetrical portion 12 to encase a jewelry composition 14 that is worn around the neck of a wearer, See FIG. 7.

Symmetrical shaped member 6 may have one axis of symmetry, for example, a triangle. Symmetrical shaped members 6 with two axis of symmetry e.g. an oval member or rectangular member are also suitable for use in embodiments of the invention. When the symmetrical shaped member 6 has two axis of symmetry, symmetric portion 11 and symmetric portion 12 refer to the symmetric portions of greatest length, which lie along the axis of symmetry of greatest length 13 (e.g. see FIG. 6). Symmetrical shaped member 6 can be formed from more than one piece of material, e.g. multiple pieces sewn together to form the member. Two or more symmetrical shaped members 6 can be releasably connected to each other to form an symmetrical shaped member of adjustable length.

As used herein, "releasably connecting", "releasably connectable", "releasably adjoining", refer to two elements (e.g. symmetrical potion 11 and portion 12) being connected to each other absent a separation force applied to one or both of the elements, and refers to the elements being capable of separation. When the necklace cover is not disposable, it is desirable that the separation does not cause substantial permanent deformation or rupture.

Any attachment means 22 for releasably connecting the symmetrical portion 11 to symmetrical portion 12 (releasable attachment means 22) that are known in the art can be used, and include, but are not limited to, hooks, snaps, buttons, hook and loop material such as Velcro™, zippers, or re-adhearing adhesive material, ties, magnet and magnet strip, or any other suitable fasteners and any combination thereof Attachment means 22 typically have a male and female member, e.g hook and ring (or eyelet, or loop), button and button hole, etc. In one embodiment, the material used for the symmetrical shaped member provides for the attachment means 22 for releasably connecting the symmetrical portion 11 to symmetrical portion 12, i.e. the material, e.g. polymer, sticks releasably to itself For example, e.g. the material used in post-it™ notes, available from 3M innovative properties corporation (U.S. Pat. No. 3,691,140), or re-attachable adhesives having tackiness such as those disclosed in U.S. Pat. Nos. 4,684,685; 5,389,438; 5827,591; 4,755,550, which are all herein incorporated by reference.

Referring to FIGS. 5-7 and 17-18, the male and female member of the releasable attachment means 22 are secured on symmetrical portion 11 and symmetrical portion 12, respectively. The attachment means 22 male and female member can be secured anywhere on symmetrical portion 11 and symmetrical portion 12, respectively. The male and female members of the releasable attachment means 22 can be attached by any manner known to a person in the art, including, but not limited to, bonding, sewing, thermocompression, coating and the like.

Any physical number and any combination of releasable attachment means 22 can be attached to the symmetrical shape member 6. In one embodiment, 1, or 2, or 3, or 4, or 5, or 6, or 7, or 8, or 9 or 10, or up to 20 releasably attachment means 22 (e.g. multiple numbers of hooks, snaps, buttons, magnets, Velcro™, e.g. strips or spots) are used.

Figure 7:
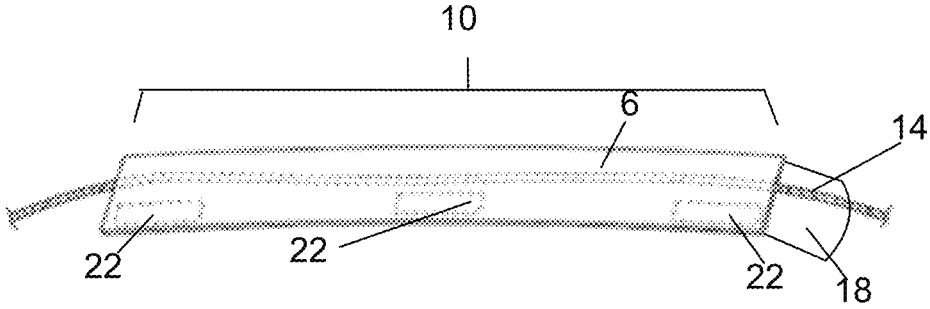
FIG. 7 is a perspective view of another embodiment of a necklace and cover according to the present invention.

Referring to FIGS. 5-7, releasable attachment means 22 is positioned along the longest outer edge symmetrical portion 11 and symmetrical portion 12. The releasable attachment means 22 is positioned at any point along the longest outer edge. In one embodiment, the releasable attachment means 22 is positioned along the longest outer edge but only at the outer corners of symmetrical portion 11 and symmetrical portion 12.

Figure 17:
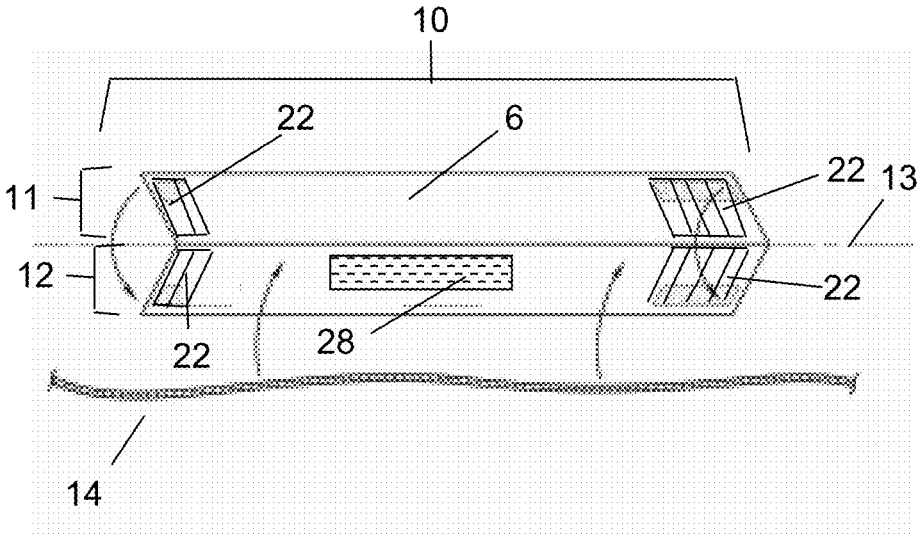
FIG. 17 is a perspective view of another embodiment of the necklace cover according to the present invention.
Figure 18:
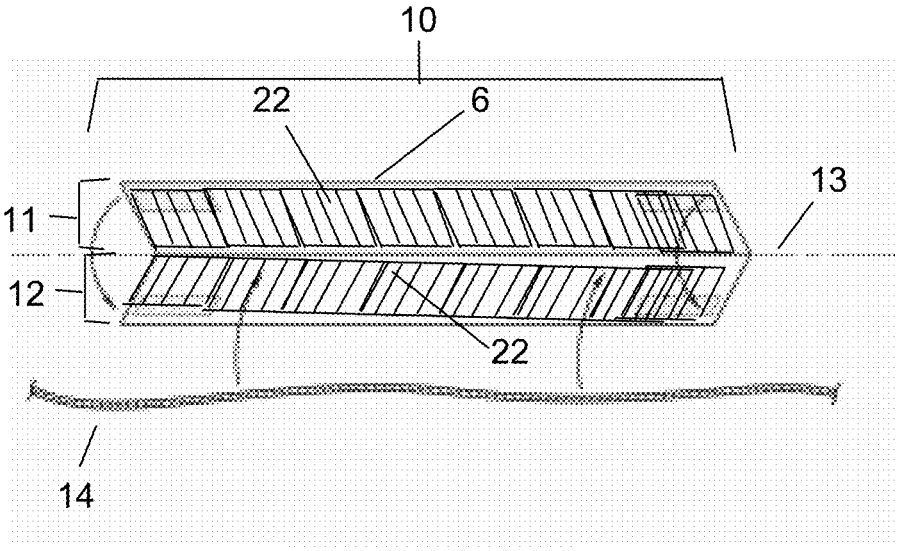
FIG. 18 is a perspective view of another embodiment of the necklace cover according to the present invention.

Referring to FIG. 17, the releasable attachment means 22 can positioned along the shortest outer edge of symmetrical portion 11 and symmetrical portion 12. Referring to FIG. 18, the releasable attachment means 22 can be positioned over the center region of symmetrical portion 11 and symmetrical portion 12 (e.g. a Velcro strip (male and female), or adhesive, attachment means 22 can be positioned over the symmetrical shaped material member such that when the necklace cover 10 is worn, the jewelry 14 is sandwiched in between the releasable attachment means 22). It should be understood that the releasable attachment 22 means can be placed any where along the symmetrical shaped material member 6 as long as symmetric portion 11 can be releasably attached to symmetric portion 12.

The symmetrical shape member 6 that has a releasable attachment means 22 to releasably adjoin symmetrical portion 11 to symmetrical portion 12, can further include, a slip resistant material 28 deposited on an interior portion of at least one of the two symmetrical portions, for example the slip resistant material 28 can be positioned at a region where releasable attachment 22 means is shown in FIGS. 17-18. It should be understood that the slip resistant material 28 can be placed any where along the interior of symmetrical shaped material member 6 as long as it comes in contact with jewelry composition 14.

The symmetrical shape member 6 that has a releasable attachment means 22 to releasably adjoin symmetrical portion 11 to symmetrical portion 12, can further include a fastener means 5 that aids in securing the releasably connected symmetrical shaped member along the chain, string, or beads of the jewelry, such as a fold over clasp or other means.

Referring to FIG. 6 symmetrical shape member 6 that has a releasable attachment means 22 to releasably adjoin symmetrical portion 11 to symmetrical portion 12, can further comprise means 18 that aids in moving the cover along the jewelry composition 14. The symmetrical shaped material member 6 can further comprise a slip resistant material 28 on an interior portion of the symmetrical shaped material member 6.

The symmetrical shaped material member 6 can have a flap of material that covers the attachment means 22 after being releasably connected e.g. a flap of material that hides buttons that have been fastened in button holes, or hides hooks or clasps after closure.

The symmetrical member 6 forming the necklace cover 10 is worn by a person by connecting the symmetrical portions 11, 12 to each other such that said symmetrical shaped member 6 encases said jewelry composition 14, this can be done at a point where said jewelry composition 14 lies at the back of the neck 15 of the wearer, alternatively the cover 10 can be releasably connected to encase any part of the jewelry 14 and moved by the wearer to the back of the neck 15. The necklace cover 10 comprising the symmetrical shaped member 6 can be placed over the jewelry 14 after the person has already put their necklace on. Thus, the cover 10 comprising the symmetrical shaped member 6 can be used to cover jewelry 14 that does not have any clasp (e.g. one continuous chain, beads or string), as well as jewelry with clasps.

As used herein, the term "encase" means to cover part of the jewelry 14, not the entire piece of jewelry 14 (e.g. the part of the jewelry 14 that lies at the back of the neck of the wearer). The term encase is also intended to mean that the symmetrical material member 6 covers a circumference of the jewelry 14, or surrounds, a portion of the jewelry 14. As used herein "adapted to encase a jewelry composition" means that the symmetrical member 6 is worn by a person to encase that portion of a jewelry composition 14 that lies at the back of a neck 15 of a wearer by connecting said symmetrical portion 11 and symmetrical portion 12 to each other such that said symmetrical shaped member 6 encases said jewelry composition 14 at a point where said jewelry composition 14 lies at the back of the neck 15 of the wearer, thereby substantially preventing tangling of the wearers hair in said jewelry composition 14 or protecting the wearers clothing from damage. The necklace cover conforms 10 to the shape of the neck of a wearer as it is designed to lie at the back of the neck 15 of a wearer.

A point where said jewelry composition 14 lies at the back of the neck 15 of the wearer refers to any point along the back of the neck 15 of the wearer see FIG. 14. In one embodiment, when the necklace cover 10 lies at the back of the neck 15, the necklace cover 10, does not cover any portion of the necklace that lies at the sides of the neck of a wearer, such that when a person looking directly at the front, or side, of the wearer the necklace can not be seen on the side of the neck.

The width of the symmetrical shaped material member 6 is at least about 1.5 cm. In one embodiment, the width of the symmetrical shaped material member 6 ranges from about 2 cm to about 20 cm. In another embodiment, the width of the symmetrical shaped material member 6 ranges from about 2 cm to about 10 cm. As described previously, the recitations of ranges are intended to include all intervening values in the alternative.

Figure 15:
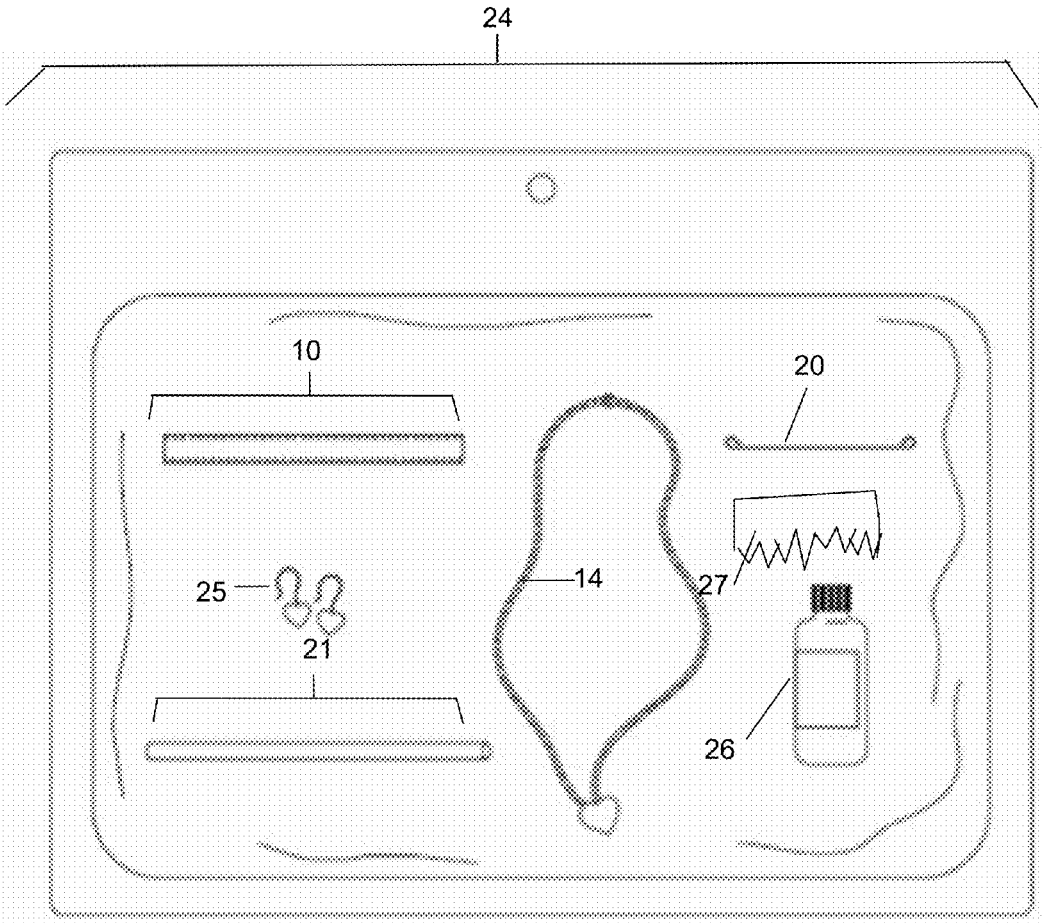
FIG. 15 is a perspective view of a package of the invention that includes a necklace cover according to the invention.

Also provided, is an accessory package 24 that includes at least one necklace cover 10 (a non-limiting example is shown in FIG. 15). The accessory package 24 can comprise a necklace cover threader, e.g. a stiff hollow tube threader 21 and/or a pull through threader 20.

Referring to FIG. 15, the accessory package 24 comprises a necklace cover 10 that has at least one tubular material member 7 having a first end 2 and a second end 3, and a lumen 4, wherein the tubular member is adapted to cover a jewelry composition 14 that is worn around a person's neck at a point where said jewelry composition 14 lies at the back of a neck 15 of a wearer. The accessory package 24 comprising a necklace cover 10, can have a necklace cover that comprises a) a symmetrical shaped material member 6 having at least one axis of symmetry and two symmetrical portions, portion 11 and portion 12; and b) at least one attachment means 22 for releasably connecting symmetrical portion 11 and said symmetrical portion 12 to each other.

The necklace cover 10 enclosed in accessory package 24 can comprise a fastener means 5 for securing the necklace cover 10 along a jewelry composition 14.

The accessory package 24 can further comprise a jewelry composition 14 that is worn around the neck, e.g. necklace, and/or other jewelry 25 that is not worn around the neck, e.g. earrings, rings, bracelets, anklet bracelets, etc., and/or a jewelry accessory 26 such as jewelry cleaner, and/or a jewelry case or organizer, and/or additional necklace covers 10.

The accessory package 24 can include at least one hair care product 27, such as, but not limited to, shampoo and/or conditioner, hair brush, hair comb, or hair styling product/s such as gels, mousse, and hairspray, or hair appliances such as curling irons, hair presses, hot or cold curlers, hairdryers, and hairdryer accessories (diffusers), also hair holding products such as barrettes, hair pins, hair bands, scarves, hair ties etc.

The accessory package 24 can further include instruction for using the necklace cover 10.

Methods are also provided. In one embodiment, a method for preventing a wearer's hair from getting tangled in a jewelry composition worn around the neck of a wearer is provided, the method comprises providing a necklace cover 10 to a wearer, wherein said necklace cover 10 is adapted to cover or encase a jewelry composition worn around the neck of a wearer.

In one embodiment, a method for preventing a wearer's hair from getting tangled in a jewelry composition worn around the neck of a wearer is provided that comprises providing a necklace cover 10 comprising at least one tubular member 7 having a first end 2 and a second end 3 and a lumen 4 to said wearer. In one aspect the necklace cover 10 provided is composed of fabric. In one embodiment, a necklace cover threader, e.g. 20, 21, is also provided and said necklace cover 10 is worn by said wearer by threading a jewelry composition 14 to be worn around the neck of a wearer through said tubular member 7 and placing said jewelry composition 14 around the neck of the wearer; the positioning the necklace cover 10 to lie at the back of the neck 15 of a wearer, thus substantially preventing tangling of the wearer's hair in said jewelry composition or protecting the wearers clothing from damage. In one embodiment, the necklace cover 10 that is provided further comprises a fastener. In one embodiment, the fastener secures the necklace cover 10 along the jewelry composition 14. In one embodiment, the necklace cover 10 that is provided further comprises a tacky or slip resistant material 28 on the inside of the cover such that the necklace cover 10 does not freely slide along the jewelry composition 14 without applied force. In one embodiment, the necklace cover 10 that is provided further comprises a fastener means 5 for securing the necklace cover 10 along the jewelry composition 14.

In another embodiment, provided is a method for preventing a wearer's hair from getting tangled in a jewelry composition worn around the neck of a wearer comprising the providing a necklace cover 10, wherein the necklace cover 10 is a symmetrical shaped material member 6 having at least one axis of symmetry and two symmetrical portions, portion 11 and portion 12; and b) at least one attachment means 22 for releasably connecting symmetrical portion 11 and symmetrical portion 12 to each other. The necklace cover 10 can be worn by the wearer by connecting said symmetrical portions 11 and 12 to each other such that said symmetrical shaped material member 6 encases a jewelry composition 14 at point where said jewelry composition 14 lies at the back of the neck 15 of the wearer, thereby substantially preventing tangling of the wearer's hair in said jewelry composition 14 or protecting the wearer's clothing from damage. In one embodiment, the necklace cover 10 that is provided further comprises a fastener, e.g. a fastener that secures the necklace cover along the jewelry composition. In one embodiment, the necklace cover 10 that is provided further comprises a tacky or slip resistant material 28 on the inside of the cover such that the necklace cover 10 does not freely slide along the jewelry composition 14 with out applied force. In one embodiment, the necklace cover 10 that is provided further comprises a fastener means 5 for securing the necklace cover 10 along the jewelry composition 14.

It should be understood that the necklace cover provided to the wearer in methods of the invention can be any variation of necklace covers described herein throughout the application.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention. The corresponding structures, materials, acts, and equivalents of all means plus function elements in the claims below are intended to include any structure, material, or acts in performing the functions in combination with other claimed elements as specifically described.

Embodiments of the invention are described in the following numbered paragraphs (1-30)

Paragraph 1: A necklace cover, comprising: a) at least one tubular material member having a first end and a second end; b) said tubular material member including a lumen for passage of a jewelry composition; and c) at least one fastener means disposed on said tubular material member for securing said necklace cover along the jewelry composition, wherein the tubular material member is adapted to cover a jewelry composition that is worn around a wearer's neck at a point where said jewelry composition lies at the back of a neck of a wearer.

Paragraph 2: The necklace cover of paragraph 1, wherein said at least one fastener means is positioned either at the first end or the second end of the tubular material member.

Paragraph 3: The necklace cover of paragraph 1, wherein said at least one fastener means is positioned between the first end and second end of the material member.

Paragraph 4: The necklace cover of paragraph 1, wherein said at least one fastener means is positioned on an inside of the tubular material member along the lumen.

Paragraph 5: The necklace cover of paragraph 1, further comprising a tab or string for pulling said tubular material member across said jewelry composition such that the necklace cover can be positioned at the back of the neck of the wearer.

Paragraph 6: A necklace cover comprising: a) at least one tubular material member having a first end and a second end; b) said tubular material member including a lumen for passage of a jewelry composition; and c) disposed on said tubular material member a means for pulling the tubular material member across said jewelry composition such that the necklace cover can be positioned at the back of the neck of the wearer, wherein said tubular member comprises a stretchy material that conforms to the shape of said jewelry composition and wherein said tubular material member is adapted to cover a jewelry composition that is worn around a person's neck at a point where said jewelry composition lies at the back of a neck of a wearer.

Paragraph 7: The necklace cover of paragraph 5 or 6, wherein said means for pulling the tubular material member across said jewelry composition is a string or tab disposed on said tubular material member.

Paragraph 8: The necklace cover of paragraph 6, wherein said stretchy material comprises a material selected from the group consisting elasticized material, stretchable polymer, neoprene, woven laminates and non-woven laminates.

Paragraph 9: A necklace cover, comprising: a) a symmetrical shaped material member having at least one axis of symmetry and at least two symmetrical portions; and b) at least one attachment means for releasably connecting said at least two symmetrical portions to each other, wherein said symmetrical shaped material member is adapted to encase a jewelry composition that lies at the back of a neck of a wearer.

Paragraph 10: The necklace cover of paragraph 9, wherein the necklace cover is worn by the wearer by connecting said at least two symmetrical portions to each other, such that said symmetrical shaped member encases said jewelry composition at a point where the jewelry composition lies at the back of the neck of the wearer.

Paragraph 11: The necklace cover of paragraph 9, further comprising a fastener means for securing the necklace cover along the jewelry composition thereby preventing the cover from sliding along the jewelry composition.

Paragraph 12: The necklace cover of paragraph 9, wherein said at least two symmetrical portions comprise a slip resistant material.

Paragraph 13: The necklace cover of paragraph 9, wherein said symmetrical shaped material member is comprised of a material selected from the group consisting of plastic, acetate, nylon, cotton, rayon, polyester, wool, silk, velvet, lace, vinyl, and leather.

Paragraph 14: The necklace cover of paragraph 1, paragraph 6, or paragraph 9, wherein said material member includes an ornamental item.

Paragraph 15: The necklace cover of any of paragraph 1, paragraph 6, or paragraph 9, wherein the necklace cover is disposable.

Paragraph 16: The necklace cover of paragraph 1, paragraph 6, or paragraph 9, wherein the necklace cover is in a package.

Paragraph 17: A package comprising a necklace cover of paragraph 1 or paragraph 6 and a necklace cover threader.

Paragraph 18: A package comprising a necklace cover of paragraph 1, paragraph 6, or paragraph 9, and a piece of jewelry.

Paragraph 19: A package comprising a necklace cover of claim paragraph 1, paragraph 6, or paragraph 9, and a hair care product.

Paragraph 20: A method for preventing a wearer's hair from getting tangled in a jewelry composition worn around the neck of a wearer; comprising: providing a necklace cover comprising at least one tubular member having a first end and a second end and a lumen.

Paragraph 21: The method of paragraph 20, further comprising providing a necklace cover threader.

Paragraph 22: The method of paragraph 20, wherein the necklace cover is made of a slip resistant material on an interior of the necklace cover.

Paragraph 23: The method of paragraph 20, further comprising providing a fastener means for securing said necklace cover along the jewelry composition.

Paragraph 24: A method of preventing a wearer's hair from getting tangled in a jewelry composition worn around the neck of a wearer, comprising the steps of: providing a necklace cover comprising a symmetrical shaped material member having at least one axis of symmetry and at least two symmetrical portions, and at least one attachment means for releasably connecting the at least two symmetrical portions to each other, wherein said necklace cover is worn by said wearer by connecting said symmetrical portions to each other such that said symmetrical shaped material member encases a jewelry composition at a point where the jewelry composition lies at the back of the neck of the wearer, thereby substantially preventing tangling of the wearers hair in the jewelry composition or protecting the wearers clothing from damage.

Paragraph 25: The method of paragraph 20 or paragraph 24, wherein the necklace cover is made of stretchy material.

Paragraph 26: The method of paragraph 20 or paragraph 24, wherein the necklace cover is disposable.

Paragraph 27: A necklace cover comprising: at least one tubular member having a first end and a second end, the tubular member having a lumen for passage of a jewelry composition, and a slip resistant material positioned along the lumen on an interior of the tubular member, wherein the tubular material member is adapted to cover a jewelry composition that is worn around a wearer's neck at a point where the jewelry composition lies at the back of a neck of a wearer.

Paragraph 28: A necklace cover comprising at least one tubular member having a first end and a second end, the tubular member having a lumen for passage of a jewelry composition and a fastener disposed on said tubular member, wherein the tubular material member is adapted to cover a jewelry composition that is worn around a wearer's neck at a point where the jewelry composition lies at the back of a neck of a wearer.

Paragraph 29: A necklace cover comprising: a) a symmetrical shaped material member having at least one axis of symmetry and at least two symmetrical portions; and b) at least one fastener disposed on said symmetrical shaped material member that is positioned to connect the two symmetrical portions to each other, wherein the symmetrical shaped material member is adapted to encase a jewelry composition that lies at the back of a neck of a wearer.

Paragraph 30: The necklace cover of paragraph 28 or paragraph 29, wherein the fastener is selected from the group consisting of hooks, snaps, buttons, hook and loop material, adhesive material, re-attachable adhesive, slip-resistant material, ties, elastic, magnets, clips, and clasps.

The references cited throughout the specification are hereby incorporated by reference in their entirety.

I claim:

1. A necklace cover, comprising:

at least one tubular material member having a first end and a second end;

the tubular material member including a lumen for passage of a necklace;

the tubular material member including a first flap and a second flap extending from the second end;

the first and second flaps each having an inside surface and an outside surface;

wherein a hook material panel is positioned on the inside surface of the first flap;

wherein a loop material panel is positioned on the inside surface of the second flap;

wherein the hook material panel and the loop material panel are engageable to form a hook-and-loop fastener that surrounds the necklace and inhibits sliding motion of the necklace cover along the necklace when the necklace cover is positioned on the necklace;

wherein the tubular material member is from 3 cm to 16 cm in length and is adapted to cover the necklace at a point where the necklace lies at the back of a neck of a wearer; and wherein the tubular material member is selected from the group consisting of: material that is sewn together to form a tube, material that is bonded to form a tube, and material that is woven or manufactured as a tube.

2. The necklace cover of claim 1, wherein the tubular material member includes an ornamental item.

3. A method for preventing a wearer's hair from getting tangled in a necklace when the necklace is worn around a neck of the wearer, comprising:

providing the necklace cover of claim 1;

providing a necklace;

inserting the necklace into the passage of the necklace cover;

positioning the necklace cover at the back of the neck of the wearer; and connecting the hook material panel to the loop material panel about a portion of the necklace to surround the portion with the hook-and-loop fastener and inhibit sliding motion of the necklace within the necklace cover.

4. The method of claim 3, wherein the necklace inserting step comprises temporarily attaching an end of the necklace to a first end of a necklace cover threader, inserting a second end of the threader, opposite to the first end of the threader, into and through the passage of the necklace cover, and then removing the necklace from the necklace cover threader.

5. A package comprising the necklace cover of claim 1, and a necklace cover threader.

6. A package comprising the necklace cover of claim 1, and a necklace.

7. A package comprising the necklace cover of claim 1, and a hair care product.

* * * * *